US009488024B2

(12) United States Patent
Hoffman et al.

(10) Patent No.: US 9,488,024 B2
(45) Date of Patent: Nov. 8, 2016

(54) ANNULUS CEMENTING TOOL FOR SUBSEA ABANDONMENT OPERATION

(71) Applicant: Wild Well Control, Inc., Houston, TX (US)

(72) Inventors: Corey Eugene Hoffman, Plantersville, TX (US); Stace Brac McDaniel, Tomball, TX (US); Christopher John Murphy, Houston, TX (US)

(73) Assignee: Wild Well Control, Inc., Houston, TX (US)

( * ) Notice: Subject to any disclaimer, the term of this patent is extended or adjusted under 35 U.S.C. 154(b) by 167 days.

(21) Appl. No.: 13/776,788

(22) Filed: Feb. 26, 2013

(65) Prior Publication Data

US 2013/0269948 A1 Oct. 17, 2013

Related U.S. Application Data

(60) Provisional application No. 61/624,552, filed on Apr. 16, 2012.

(51) Int. Cl.

| | |
|---|---|
| ***E21B 43/11*** | (2006.01) |
| ***E21B 33/16*** | (2006.01) |
| ***E21B 33/035*** | (2006.01) |
| ***E21B 29/12*** | (2006.01) |
| ***E21B 33/13*** | (2006.01) |

(52) U.S. Cl.

CPC ..... *E21B 33/035* (2013.01); *E21B 29/12* (2013.01); *E21B 33/13* (2013.01); *E21B 43/11* (2013.01)

(58) Field of Classification Search

None

See application file for complete search history.

(56) References Cited

U.S. PATENT DOCUMENTS

| | | | | |
|---|---|---|---|---|
| 2,947,250 A | | 8/1960 | Mohaunpt | |
| 3,111,989 A | | 11/1963 | Tamplen | |
| 4,560,000 A | | 12/1985 | Upchurch | |
| 5,301,755 A | * | 4/1994 | George | E21B 43/11852 166/297 |
| 5,372,198 A | * | 12/1994 | North | E21B 29/12 166/363 |
| 5,675,900 A | * | 10/1997 | Favre | 30/509 |

(Continued)

FOREIGN PATENT DOCUMENTS

| | | |
|---|---|---|
| EP | 0877852 A1 | 8/2001 |
| GB | 2309717 A | 8/1997 |

(Continued)

OTHER PUBLICATIONS

Baker Hughes—"Wellhead Abandonment Straddle Packer for Driver-Less Operations," date unknown, 1 page.

(Continued)

*Primary Examiner* — Matthew R Buck
*Assistant Examiner* — Douglas S Wood
(74) *Attorney, Agent, or Firm* — Patterson & Sheridan, LLP

(57) ABSTRACT

A method for abandonment of a subsea well includes: fastening a pressure control assembly (PCA) to a subsea wellhead; and deploying a tool string into the PCA. The tool string includes a packer and an upper perforator located above the packer. The method further includes: closing a bore of the PCA above the tool string with a solid barrier; and setting the packer against an inner casing hung from the subsea wellhead. The method further includes, while the PCA bore is closed, perforating a wall of the inner casing by operating the upper perforator. The method further includes injecting cement slurry into an inner annulus formed between the inner casing and an outer casing hung from the subsea wellhead.

36 Claims, 30 Drawing Sheets

(56) References Cited

U.S. PATENT DOCUMENTS

| | | | | |
|---|---|---|---|---|
| 5,954,133 | A * | 9/1999 | Ross | E21B 17/07 166/297 |
| 6,360,822 | B1 | 3/2002 | Robertson | |
| 6,478,088 | B1 | 11/2002 | Hansen et al. | |
| 6,675,900 | B2 * | 1/2004 | Baskett et al. | 166/379 |
| 7,021,375 | B2 * | 4/2006 | Ringgenberg | E21B 21/002 166/186 |
| 7,438,135 | B2 * | 10/2008 | Page | E21B 33/035 166/127 |
| 2005/0263282 | A1 | 12/2005 | Jeffrey et al. | |
| 2007/0163783 | A1 | 7/2007 | Head | |
| 2008/0314591 | A1 | 12/2008 | Hales et al. | |
| 2009/0255680 | A1 | 10/2009 | Maxwell | |
| 2010/0163244 | A1 | 7/2010 | Desai et al. | |
| 2011/0108275 | A1 | 5/2011 | Borak et al. | |
| 2011/0203795 | A1 | 8/2011 | Murphy et al. | |
| 2012/0037374 | A1 * | 2/2012 | Schuurman et al. | 166/340 |
| 2012/0043089 | A1 | 2/2012 | Hoffman et al. | |

FOREIGN PATENT DOCUMENTS

| | | | |
|---|---|---|---|
| GB | 2414492 | A | 11/2005 |
| WO | 2012057631 | A1 | 5/2012 |

OTHER PUBLICATIONS

Subsea P&A AS—"Solutions for Subsea Well Abandonment", Presentation to the Norwegian P&A Forum Workshop, Jun. 2011, 22 pages.

Subsea P&A AS—"SPA's Cat 2 way," date unknown, 2 pages.

Edwards, Jon, et al.—"New system enables rigless subsea well abandonment," as seen in Feb. 2009 issue of E&P, 2 pages.

* cited by examiner 50
54
53
56
61
52
78
79
75
76
55
51
63
1w
60
62
77
82
90
81
20
80
24i
24o
15
10

71
73
65
60
47b
47p
72
47a
70
66a
76a

ANNULUS CEMENTING TOOL FOR SUBSEA ABANDONMENT OPERATION

BACKGROUND OF THE INVENTION

1. Field of the Invention

The present invention generally relates to an annulus cementing tool for a subsea abandonment operation.

2. Description of the Related Art

FIGS. 1A-1C illustrate a prior art completed subsea well. A conductor string 3 may be driven into a floor 1*f* of the sea 1. The conductor string 3 may include a housing 3*h* and joints of conductor pipe 3*p* connected together, such as by threaded connections. Once the conductor string 3 has been set, a subsea wellbore 2 may be drilled into the seafloor 1*f* and extend into one or more upper formations 9*u*. A surface casing string 4 may be deployed into the wellbore 3. The surface casing string 4 may include a wellhead housing 4*h* and joints of casing 4*c* connected together, such as by threaded connections. The wellhead housing 4*h* may land in the conductor housing 3*h* during deployment of the surface casing string 4. The surface casing string 4 may be cemented 8*s* into the wellbore 2. Once the surface casing string 2 has been set, the wellbore 2 may be extended and an intermediate casing string 5 may be deployed into the wellbore. The intermediate casing string 5 may include a hanger 5*h* and joints of casing 5*c* connected together, such as by threaded connections. The intermediate casing string 5 may be cemented 8*i* into the wellbore 2.

Once the intermediate casing string 5 has been set, the wellbore 2 may be extended into and a hydrocarbon-bearing (i.e., crude oil and/or natural gas) reservoir 9*r*. The production casing string 6 may be deployed into the wellbore. The production casing string 6 may include a hanger 6*h* and joints of casing 6*c* connected together, such as by threaded connections. The production casing string 6 may be cemented 8*p* into the wellbore 2. Each casing hanger 5*h*, 6*h* may be sealed in the wellhead housing 4*h* by a packoff. The housings 3*h*, 4*h* and hangers 5*h*, 6*h* may be collectively referred to as a wellhead 10.

A production tree 15 may be connected to the wellhead 10, such as by a tree connector 13. The tree connector 13 may include a fastener, such as dogs, for fastening the tree to an external profile of the wellhead 10. The tree connector 13 may further include a hydraulic actuator and an interface, such as a hot stab, so that a remotely operated subsea vehicle (ROV) 80 (FIG. 2A) may operate the actuator for engaging the dogs with the external profile. The tree 15 may be vertical or horizontal. If the tree is vertical (not shown), it may be installed after a production tubing string 7 is hung from the wellhead 10. If the tree 15 is horizontal (as shown), the tree may be installed and then the production tubing 7 may be hung from the tree 15. The tree 15 may include fittings and valves to control production from the wellbore into a pipeline (not shown) which may lead to a production facility (not shown), such as a production vessel or platform.

The production tubing string 7 may include a hanger 7*h* and joints of production tubing 7*t* connected together, such as by threaded connections. The production tubing string 7 may further include a subsurface safety valve (SSV) 7*v* interconnected with the tubing joints 7*t* and a hydraulic conduit 7*c* extending from the valve 7*v* to the hanger 7*h*. The production tubing string 7 may further include a production packer 7*p* and the packer may be set between a lower end of the production tubing and the production casing 6 to isolate an annulus 7*a* (aka the A annulus) formed therebetween from production fluid (not shown). The tree 15 may also be in fluid communication with the hydraulic conduit 7*c*. A lower end of the production casing 6 may be perforated 11 to provide fluid communication between the reservoir 9*r* and a bore of the production tubing 7. The production tubing 7 may transport production fluid from the reservoir 9*r* to the production tree 15.

The tree 15 may include a head 12, the tubing hanger 7*h*, the tree connector 13, an internal cap 14, an external cap 16, an upper crown plug 17*u*, a lower crown plug 17*b*, a production valve 18*p*, one or more annulus valves 18*u,b*, and a face seal 19. The tree head 12, tubing hanger 7*h*, and internal cap 14 may each have a longitudinal bore extending therethrough. The tubing hanger 7*h* and head 12 may each have a lateral production passage formed through walls thereof for the flow of production fluid. The tubing hanger 7*h* may be disposed in the head bore. The tubing hanger 7*h* may be fastened to the head by a latch.

Once the reservoir 9*r* has been produced to depletion, the well must be abandoned. Conventionally, an abandonment operation includes cutting into the casings and filling the annuli with cement to seal the upper regions of the annuli. To achieve this, it is usual to use a semi-submersible drilling vessel (SSDV) which is located above the well and anchored in position. After removal of the cap 16 from the well, a unit including blow-out preventers and a riser is lowered and locked on to the wellhead. A tool string is run on pipe to sever or perforate the casing or casings. Weighted fluid is pumped into the well to provide a hydrostatic head to balance any possible pressure release when the casing is cut. The casing is then cut, and the annulus cemented. The cemented annulus is then pressure tested to ensure an adequate seal has been obtained. The casing is severed below the mud line and the casing hangers retrieved, and finally after removal from the well, the well is filled with cement. Whilst by this procedure satisfactory well abandonment can be achieved, it is expensive in terms of the equipment involved and the time taken which is often from 7 to 10 days per well.

SUMMARY OF THE INVENTION

The present invention generally relates to an annulus cementing tool for a subsea abandonment operation. In one embodiment, a method for abandonment of a subsea well includes: fastening a pressure control assembly (PCA) to a subsea wellhead; and deploying a tool string into the PCA. The tool string includes a packer and an upper perforator located above the packer. The method further includes: closing a bore of the PCA above the tool string with a solid barrier; and setting the packer against an inner casing hung from the subsea wellhead. The method further includes, while the PCA bore is closed, perforating a wall of the inner casing by operating the upper perforator. The method further includes injecting cement slurry into an inner annulus formed between the inner casing and an outer casing hung from the subsea wellhead.

In another embodiment, a tool string for abandonment of a subsea well includes: a hanger having an external seal and an external latch; a perforator connected to the hanger and operable in response to pressure of an exterior of the tool string exceeding pressure of a bore of the tool string by a predetermined pressure differential; a packer connected to the perforating gun; and a closure member for closing the bore. The tool string is tubular.

In another embodiment, a method for abandonment of a subsea well includes: fastening a pressure control assembly (PCA) to a subsea production tree; and deploying a tool string into the PCA. The tool string includes a packer and an upper perforator located above the packer. The method further includes: closing a bore of the PCA above the tool string with a solid barrier; and setting the packer against production tubing hung from the subsea tree or a subsea wellhead. The method further includes, while the PCA bore is closed, perforating a wall of the production tubing by operating the upper perforator. The method further includes injecting cement slurry into an inner annulus formed between the production tubing and an inner casing hung from the subsea wellhead.

In another embodiment, a method for abandonment of a subsea well includes: setting a packer against a bore of an inner casing hung from a subsea wellhead; fastening a pressure control assembly (PCA) to the subsea wellhead; and deploying a tool string into the PCA and stabbing the tool string into the packer. The tool string includes a stinger and an upper perforator located above the stinger. The method further includes closing a bore of the PCA above the tool string with a solid barrier. The method further includes, while the PCA bore is closed, perforating a wall of the inner casing by operating the upper perforator. The method further includes injecting cement slurry into an inner annulus formed between the inner casing and an outer casing hung from the subsea wellhead.

In another embodiment, a perforating gun for use in a subsea well includes: a tubular housing; a bore formed therethrough and isolated from an exterior of the tool; one or more shaped charges disposed in a chamber of the housing isolated from the bore; a blasting cap; detonation cord connecting the blasting cap to the shaped charges; a piston in fluid communication with an exterior of the gun and the bore; a fastener restraining the piston and operable to release the piston in response to a predetermined pressure differential between the exterior and the bore; and a firing mechanism operably coupled to the piston such that the mechanism strikes the blasting cap in response to release of the piston. The chamber remains isolated from the bore after firing of the shaped charges.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 2A illustrates deployment of a pressure control assembly (PCA) to the subsea production tree. FIG. 2B illustrates deployment of an umbilical to the PCA. FIG. 2C illustrates deployment and connection of a fluid conduit to the PCA. FIG. 2D illustrates deployment of a plug running tool (PRT) and wireline module to the subsea production tree. FIG. 2E illustrates connection of the wireline module to the PCA.

FIGS. 3A-3C illustrate cement plugging of a lower portion of the tubing annulus and the reservoir. FIG. 3D illustrates setting a lower bridge plug in the production tubing. FIGS. 3E and 3F illustrate cement plugging of an intermediate portion of the tubing annulus. FIG. 3G illustrates setting an intermediate bridge plug in the production tubing. FIG. 3H illustrates cutting of the production tubing. FIGS. 3I and 3J illustrate retrieval of the production tree.

FIG. 6A illustrates deployment of the tool string to the subsea wellhead and the second PCA. FIGS. 6B and 6C illustrate the tool string landed in the second PCA. FIG. 6D illustrates inflating a packer of the tool string. FIG. 6E illustrates deployment of a second PRT to the subsea wellhead. FIG. 6F illustrates removing a plug of the tool string.

FIGS. 7A-7C illustrate cement plugging of an annulus formed between the production casing and the intermediate casing. FIGS. 7D-7F illustrate cement plugging of an annulus formed between the intermediate casing and the surface casing.

FIG. 8A illustrates setting an upper bridge plug in the production casing. FIG. 8B illustrates cement plugging of the production casing hanger.

DETAILED DESCRIPTION

Figure 1A:
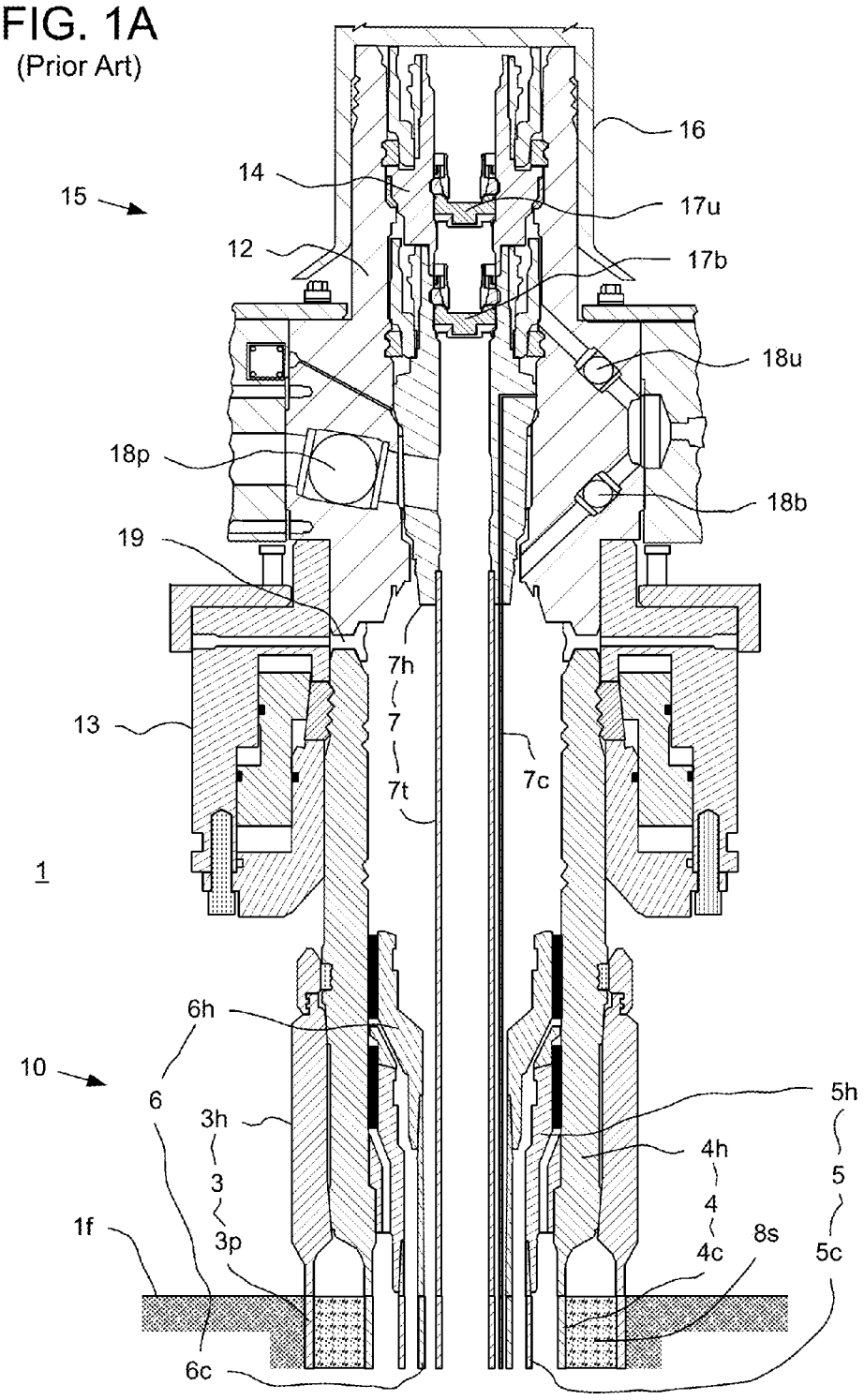
FIG. 1A (Prior Art)
FIGS. 1A-1C illustrate a prior art completed subsea well.
Figure 1B:
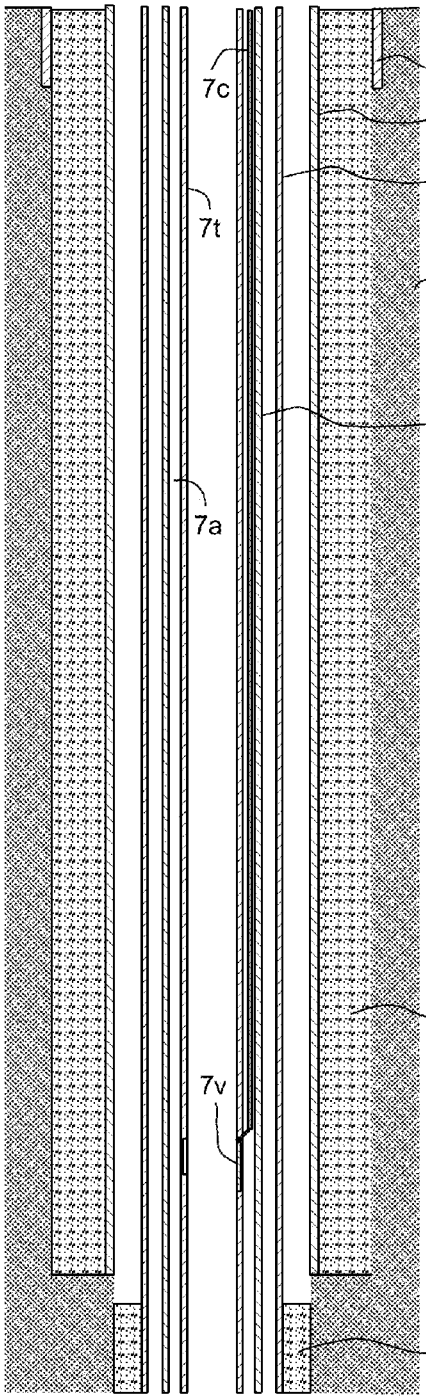
FIG. 1B (Prior Art)
Figure 1C:
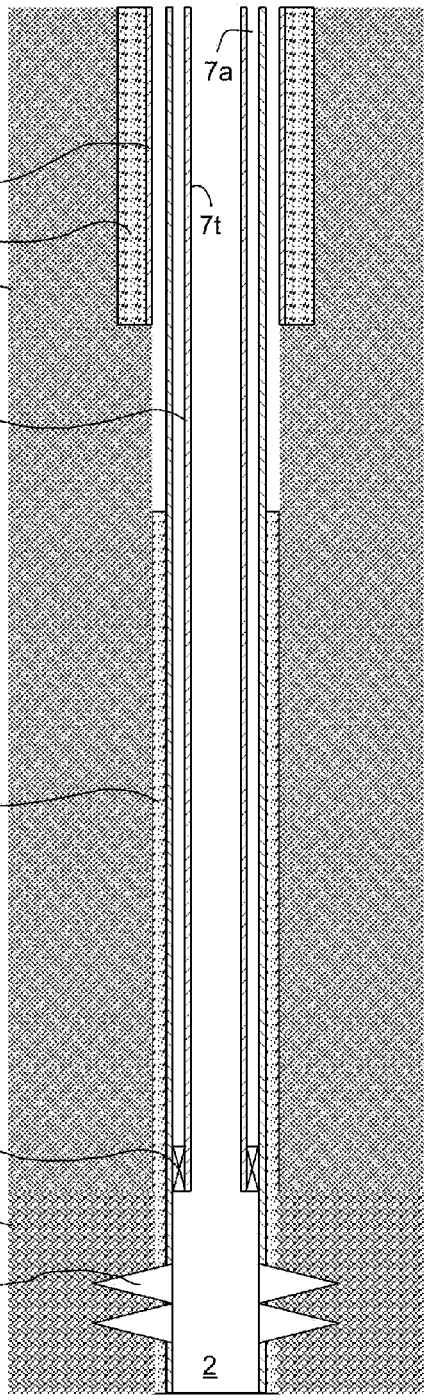
FIG. 1C (Prior Art)
Figure 2A:
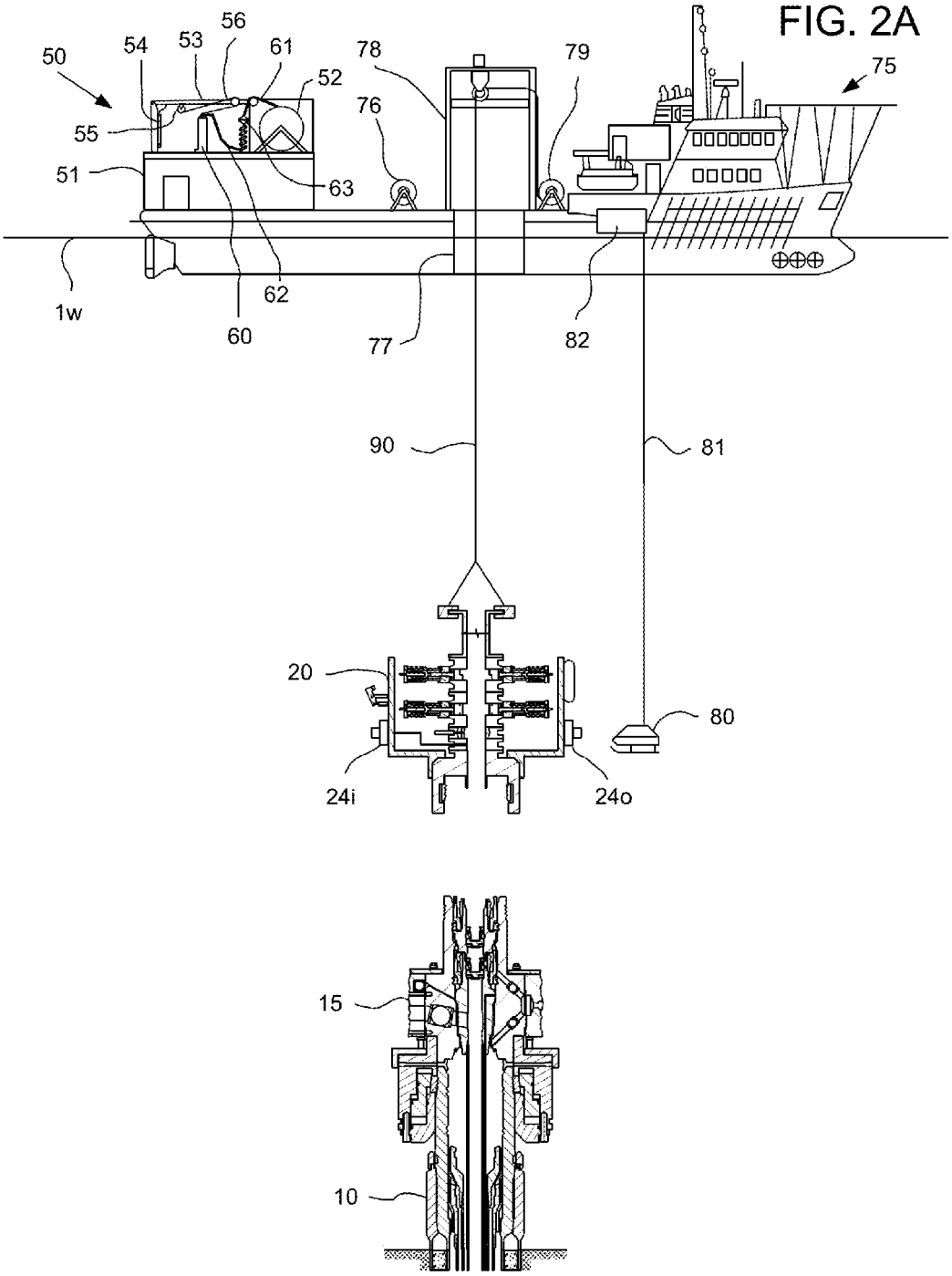
FIGS. 2A-2E illustrate preparation of the well for an abandonment operation.
Figure 2B:
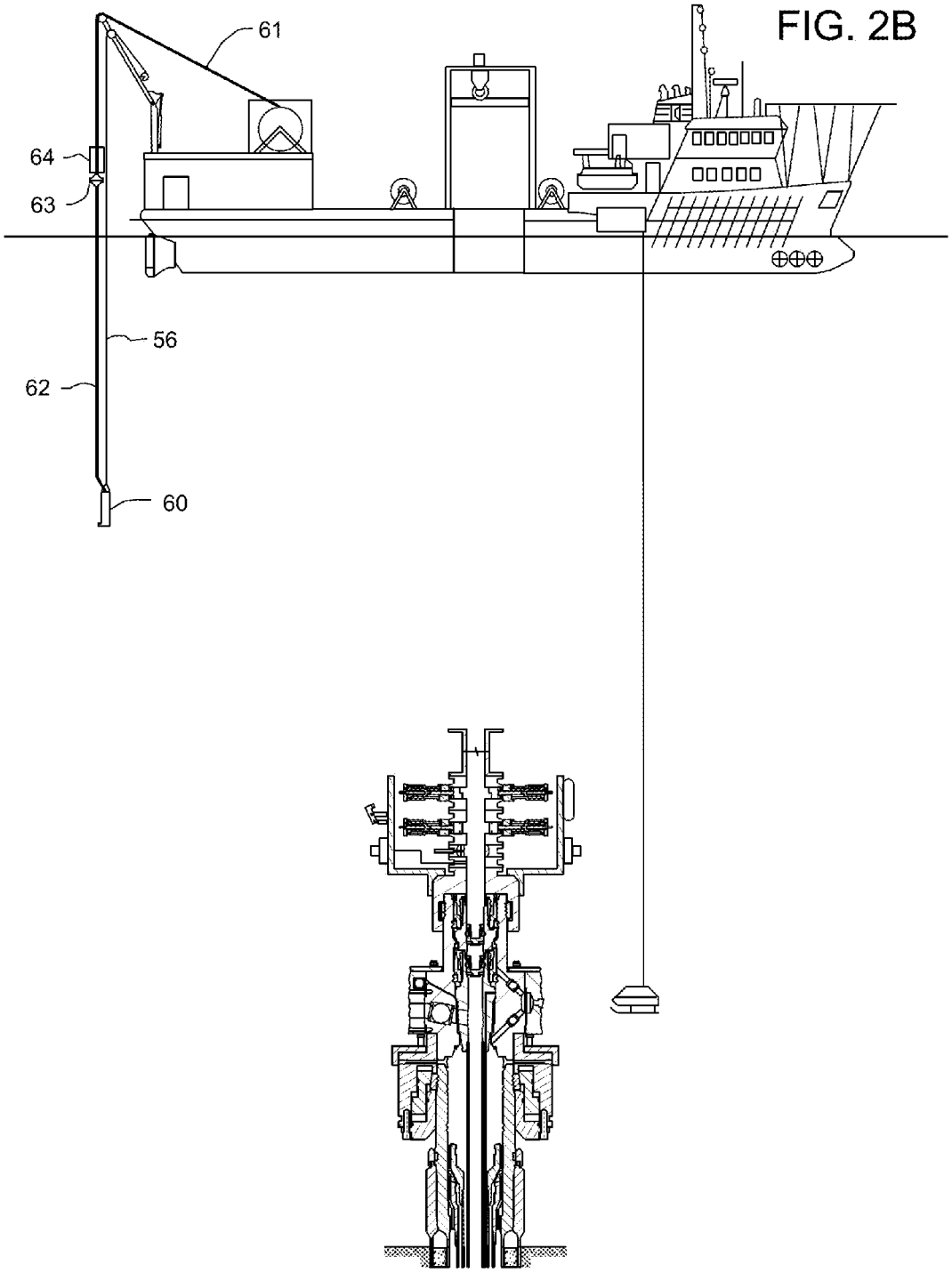
Figure 2C:
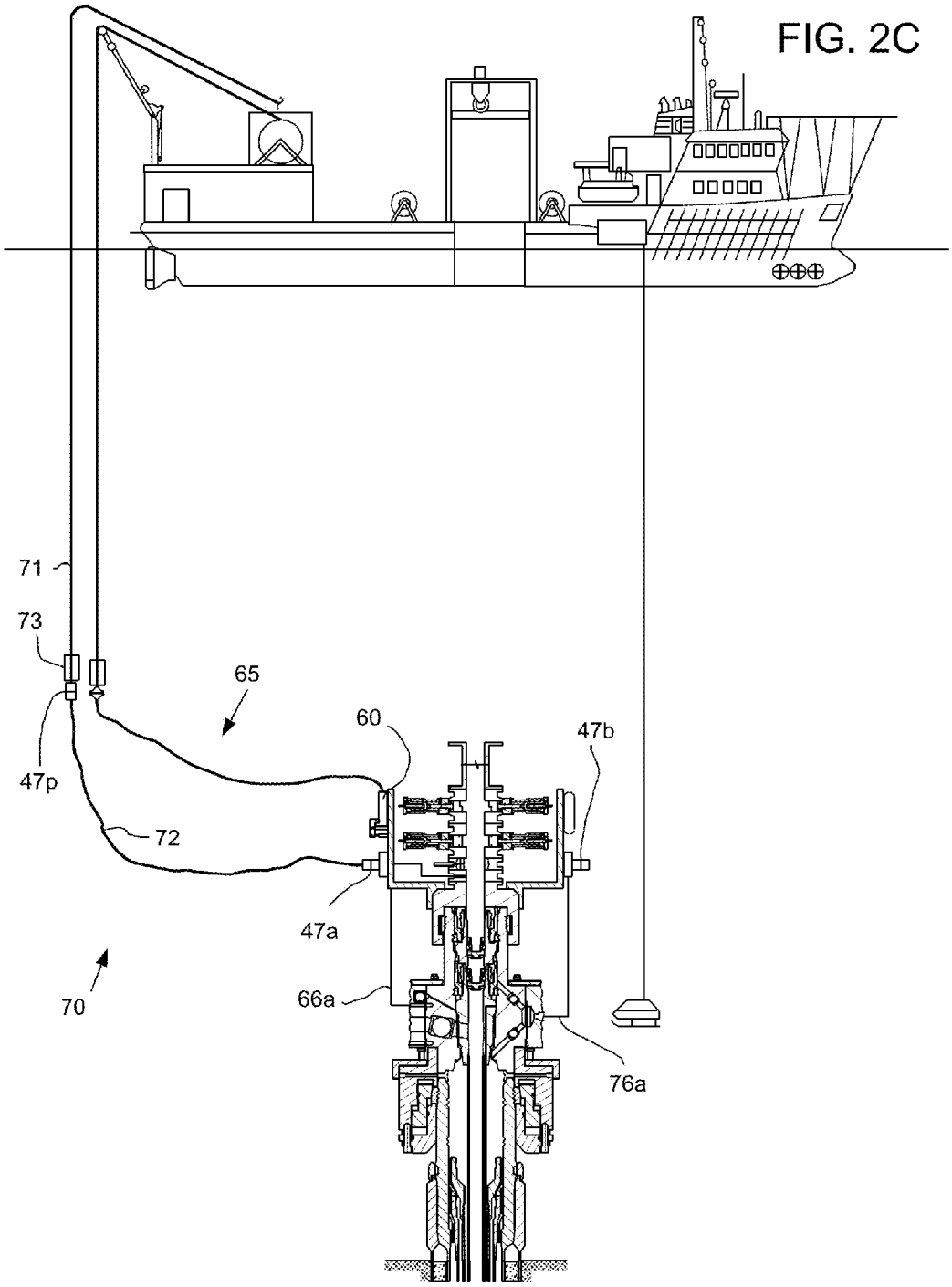
Figure 2D:
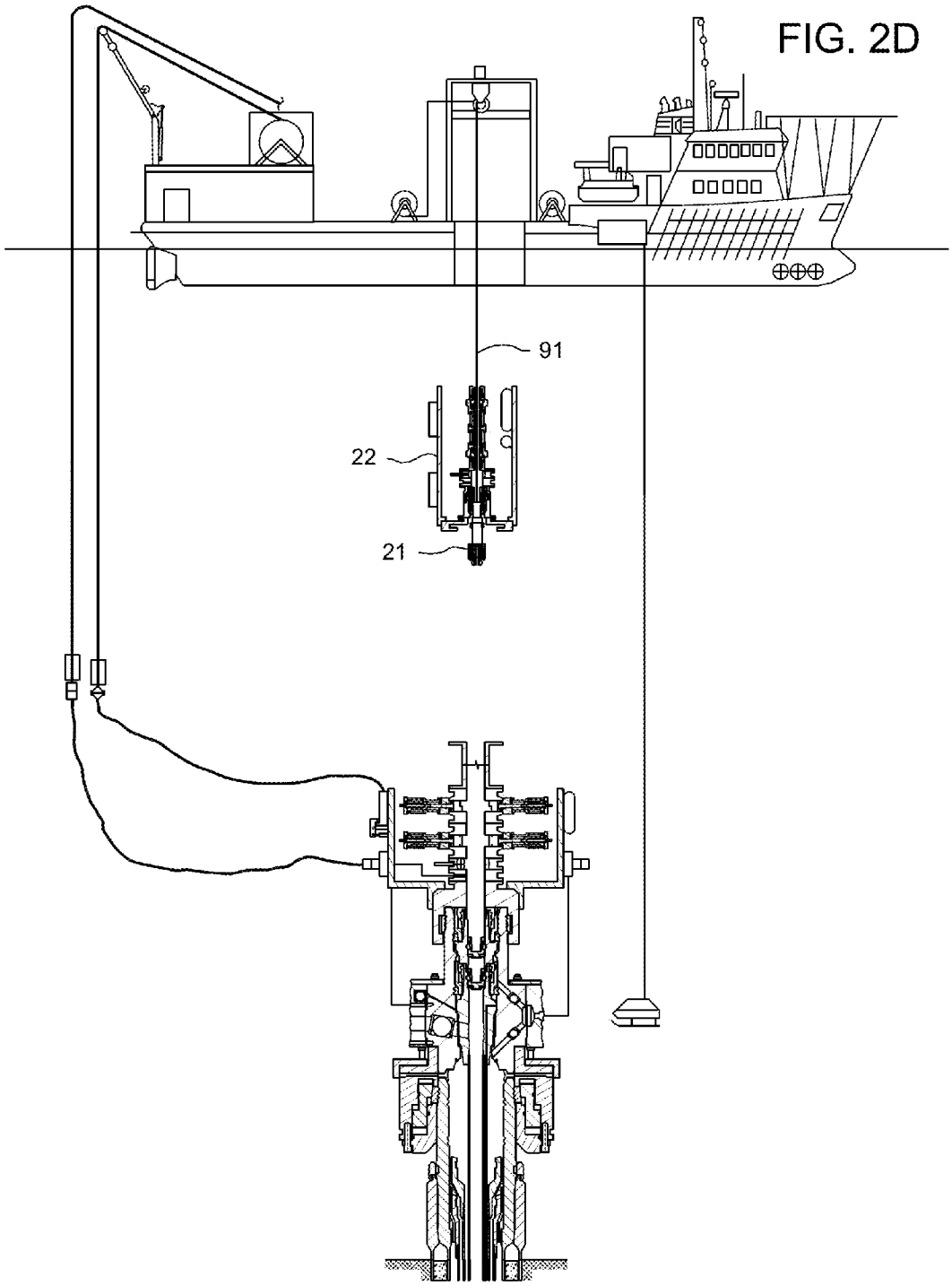

FIGS. 2A-2E illustrate preparation of the well for an abandonment operation. FIG. 2A illustrates deployment of a pressure control assembly (PCA) 20 to the subsea production tree. The PCA 20 may include a tree adapter, a fluid sub, an isolation valve, a blow out preventer (BOP) stack, a tool housing (aka lubricator riser), a frame, one or more manifolds, such as an intake 24*i* and an outtake 24*o*, a termination receptacle, one or more accumulators, and a subsea control system. The tree adapter, fluid sub, isolation valve, BOP stack, and tool housing may each include a housing or body having a longitudinal bore therethrough and be connected, such as by flanges, such that a continuous bore is maintained therethrough. The bore may have a large drift diameter, such as greater than or equal to four, five, six, or seven inches to accommodate a plug running tool (PRT) 21 (FIG. 2D) or a bottom hole assembly (BHA) 23 (FIG. 3A) of a workline and the crown plugs 17*u,b* of the tree 15. The workline may be wireline 91 (FIG. 2D). Alternatively, the workline may be slickline or sandline. Alternatively, a workstring, such as coiled tubing, may be used instead of the workline.

The tree adapter may include a connector, such as dogs, for fastening the PCA 20 to an external profile of the tree 15 and a seal sleeve for engaging an internal profile of the tree. Alternatively, the tree adapter may include a seal face instead of the seal sleeve. The tree adapter may further include an electric or hydraulic actuator and an interface, such as a hot stab, so that the ROV 80 may operate the actuator for engaging the dogs with the external profile. The frame may be connected to the tree connector, such as by fasteners (not shown). The manifolds may each be fastened to the frame. The fluid sub may include a housing having a bore therethrough and a port in communication with the bore. The fluid sub port may be in fluid communication with the first manifold via a fluid conduit.

The isolation valve may include a housing, a valve member disposed in the housing bore and operable between an open position and a closed position, and an actuator operable to move the valve member between the positions. The actuator may be electric or hydraulic and may be in communication with a stab plate (not shown) of the termination receptacle. The isolation valve may further operate as a check valve in the closed position: allowing fluid flow downward from the tool housing into the wellbore and preventing reverse fluid flow therethrough. Alternatively, the isolation valve may be bi-directional when closed, the PCA 20 may further include a bypass conduit (not shown) connected to a port of a drain sub (not shown) disposed between the isolation valve and the BOP stack, and the drain port may include a check valve allowing downward flow and preventing reverse flow.

The BOP stack may include one or more hydraulically operated ram preventers, such as a blind-shear preventer and a wireline preventer, connected together via bolted flanges. Each ram preventer may include two opposed rams disposed within a body. The body may have a bore that is aligned with the wellbore. Opposed cavities may intersect the bore and support the rams as they move radially into and out of the bore. A bonnet may be connected to the body on the outer end of each cavity and may support an actuator that provides the force required to move the rams into and out of the bore. Each actuator may include a hydraulic piston to radially move each ram and a mechanical lock to maintain the position of the ram in case of hydraulic pressure loss. The lock may include a threaded rod, a motor (not shown) for rotationally driving the rod, and a threaded sleeve. Once each ram is hydraulically extended into the bore, the motor may be operated to push the sleeve into engagement with the piston. Each actuator may include single or dual pistons. The blind-shear preventer may cut the wireline when actuated and seal the bore. The wireline preventer may seal against an outer surface of wireline when actuated.

The tool housing may be of sufficient length to contain either the PRT 21 or a BHA 23 so that the PCA 20 may be closed while deploying a wireline module 22 (FIG. 2D). The tool housing may have a connector profile for receiving an adapter of the wireline module 22.

The termination receptacle may be operable to receive a termination head 60 (FIG. 2B) of a subsea control line. The termination receptacle may include a base, a latch, and an actuator. The receptacle base may be connected to the frame, such as by fasteners, and may include a landing plate for supporting the termination head 60, a landing guide (not shown), such as a pin, and the stab plate. The receptacle stab plate and termination head, when connected (termination assembly), may provide communication, such as electric (power and/or data), hydraulic, or optic, between the subsea control line and the subsea control system. The subsea control system may be mounted on the PCA 20 or a subsea skid or may be integrated with the termination head 60. The receptacle latch may be pivoted to the base, such as by a fastener, and be movable by the actuator between an engaged position (FIG. 2C) and a disengaged position (shown). The receptacle actuator may be a piston and cylinder assembly connected to the frame and the receptacle may further include an interface (not shown), such as a hot stab, so that the ROV 80 may operate the receptacle actuator. The receptacle actuator may also be in communication with the stab plate for operation via the subsea control line. The receptacle latch may include outer members and a crossbar (not shown) connected to each of the outer members by a shearable fastener. The receptacle actuator may be dual function so that the latch may be locked in either of the positions by either the ROV 80 or the control line.

The subsea control system may be in electric, hydraulic, and/or optic communication with a surface control system of a control van 51 onboard a support vessel 75 via the subsea control line, such as an umbilical 65 (FIG. 2C). Alternatively, the subsea control line may be a hydraulic flying lead or an electrical cable. The subsea control system may include a control pod having one or more control valves (not shown) in communication with the BOP stack (via the stab plate) for operating the BOP stack. Each pod control valve may include an electric or hydraulic actuator in communication with the umbilical 65. The umbilical 65 may include one or more hydraulic or electric control conduit/cables for each actuator. The accumulators may store pressurized hydraulic fluid for operating the BOP stack. Additionally, the accumulators may be used for operating one or more of the other components of the PCA 20. The accumulators may be charged via a conduit of the umbilical 65 or by the ROV 80.

Figure 2E:
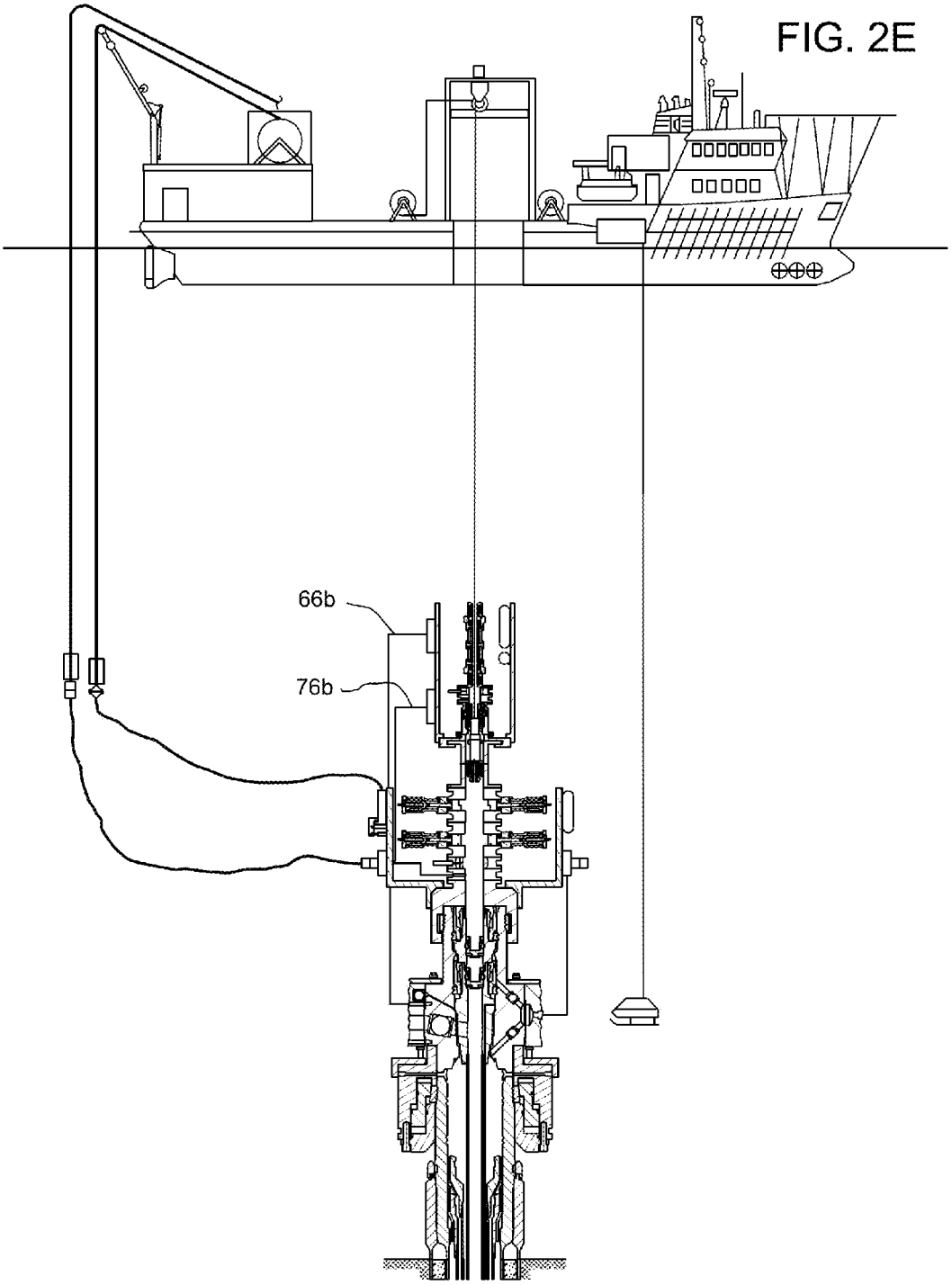

The umbilical 65 may further include hydraulic, electric, and/or optic control conduit/cables for operating valves of the manifolds, the actuators, tree valves 18*u,b,p* and the various functions of the wireline module 22. The stab plate may further include an output for the wireline module 22 and an output for the tree 15. Each output may include an ROV operable connector for receiving a respective jumper 66*a,b* (aka flying lead) (FIGS. 2C and 2E). The ROV 80 may connect the tree jumper 66*a* to a control panel (not shown) of the tree 15 and the wireline module jumper 66*b* to a respective control relay of the wireline module 22. The umbilical 65 may further include one or more layers of armor (not shown) made from a high strength metal or alloy, such as steel, for supporting the umbilical's own weight and weight of the termination head 60.

The subsea control system may further include a microprocessor based controller, a modem, a transceiver, and a power supply. The power supply may receive an electric power signal from a power cable of the umbilical 65 and convert the power signal to usable voltage for powering the subsea control system components as well as any of the PCA components. The PCA 20 may further include one or more pressure sensors (not shown) in communication with the PCA bore at various locations. The wireline module 22 may also include one or more pressure sensors in communication with a respective bore thereof at various locations. The modem and transceiver may be used to communicate with the control van 51 via the umbilical 65. The power cable may be used for data communication or the umbilical 65 may further include a separate data cable (electric or optic). The control van 51 may include a control panel (not shown) so that the various functions of the PCA 20, the tree 15, and the wireline module 22 may be operated by an operator on the vessel 75.

The subsea control system may also include a dead-man's system (not shown) for closing the BOP stack in response to a loss of communication with the control van 51. Alternatively, or in addition to having individual conduits/cables for controlling each function of the PCA 20, tree 15, and wireline module 22, the subsea control system may receive multiplexed instruction signals from the van operator via a single electric, hydraulic, or optic control conduit/cable of the umbilical 65 and then operate the various functions using individual conduits/cables extending from the subsea control system.

The intake manifold 24*i* may include a pair of actuated shutoff valves (not shown) and a coupling, such as a dry break coupling, for receiving a mating coupling of a supply fluid conduit 70 (FIG. 2C) from the vessel 75. The outtake manifold 24*o* may include an actuated shutoff valve (not shown) and a coupling, such as a dry break coupling, for receiving a mating coupling of a return fluid conduit (not shown) from the vessel 75. An actuator of each manifold valve and the couplings of dry break connections 47*a,b* may be in communication with the subsea control system via the stab plate. Each fluid conduit 70 may extend from the vessel 75 to the respective manifold 24*i,o* for fluid circulation. The actuated shutoff valves of the intake manifold 47*i* may each be in fluid communication with the coupling of dry break connection 47*a* and one of the shutoff valves may be in fluid communication with the fluid sub and another may be in fluid communication with a connector for receiving a jumper 76*b* (FIG. 2E) providing fluid communication with a respective junction plate of the wireline module 22. The actuated shutoff valve of the outtake manifold 47*o* may be in fluid communication with the coupling of dry break connection 47*b* and may be in fluid communication with a connector for receiving a jumper 76*a* (FIG. 2C) providing fluid communication with an annulus port of the tree 15.

The dry break connections 47*a,b* may each have actuators for release. Each of the dry break actuators may also have a shearable release. Suitable dry break connections are discussed and illustrated at FIGS. 3A-3C of U.S. patent application Ser. No. 13/095,596, filed Apr. 27, 2011 , which is herein incorporated by reference in its entirety.

In operation, the support vessel 75 may be deployed to a location of the subsea tree 15. The support vessel 75 may be a light or medium intervention vessel and include a dynamic positioning system to maintain position of the vessel 75 on the waterline 1*w* over the tree 15 and a heave compensator (not shown) to account for vessel heave due to wave action of the sea 1. Alternatively, the vessel 75 may be a mobile offshore drilling unit (MODU). The vessel 75 may further include a tower 78 located over a moonpool 77 and a winch 79. The winch 79 may include a drum having wire rope 90 wrapped therearound and a motor for winding and unwinding the wire rope, thereby raising and lowering a distal end of the wire rope relative to the tower 78. Alternatively, a crane (not shown) may be used instead of the winch and tower. The vessel 75 may further include a wireline winch 76.

The ROV 80 may be deployed into the sea 1 from the vessel 75. The ROV 80 may be an unmanned, self-propelled submarine that includes a video camera, an articulating arm, a thruster, and other instruments for performing a variety of tasks. The ROV 80 may further include a chassis made from a light metal or alloy, such as aluminum, and a float made from a buoyant material, such as syntactic foam, located at a top of the chassis. The ROV 80 may be controlled and supplied with power from vessel 75. The ROV 80 may be connected to support vessel 75 by an umbilical 81. The umbilical 81 may provide electrical (power), hydraulic, and/or data communication between the ROV 80 and the support vessel 75. An operator on the support vessel 75 may control the movement and operations of ROV 80. The umbilical 81 may be wound or unwound from drum 82.

The ROV 80 may be deployed to the tree 15. The ROV 80 may transmit video to the ROV operator for inspection of the tree 15. The ROV 80 may remove the external cap 16 from the tree 15 and carry the cap to the vessel 75. Alternatively, the winch 79 may be used to transport the external cap 16 to the waterline 1*w*. The ROV 80 may then inspect an internal profile of the tree 15. The wire rope 90 may then be used to lower the PCA 20 to the tree 15 through the moonpool 77 of the vessel 75. The ROV 80 may guide landing of the PCA 20 on the tree 15. The ROV 80 may then operate the PCA adapter connector to fasten the PCA 20 to the tree 15.

FIG. 2B illustrates deployment of the umbilical 65 to the PCA 20. The vessel 75 may further include a launch and recovery system (LARS) 50 for deployment of the termination head 60 and the umbilical 65. The LARS 50 may include a frame, an umbilical winch 52, a boom 53, a boom hoist 54, a load winch 55, and a hydraulic power unit (HPU, not shown). The LARS 50 may be the A-frame type (shown) or the crane type (not shown). For the A-frame type LARS 50, the boom 53 may be an A-frame pivoted to the frame and the boom hoist 54 may include a pair of piston and cylinder assemblies, each piston and cylinder assembly pivoted to each beam of the boom and a respective column of the frame. The HPU may include a hydraulic fluid reservoir, a hydraulic pump, and one or more control valves for selectively providing fluid communication between the reservoir, the pump, and the piston and cylinder assemblies. The hydraulic pump may be driven by an electric motor.

The umbilical 65 may include an upper portion 61 and a lower portion 62 fastened together by a shearable connection 63. Each winch 52, 55 may include a drum having the respective umbilical upper portion 61 or load line 56 wrapped therearound and a motor for rotating the drum to wind and unwind the umbilical upper portion or load line. The load line 56 may be wire rope. Each winch motor may be electric or hydraulic. An umbilical sheave and a load sheave may each hang from the A-frame 53. The umbilical upper portion 61 may extend through the umbilical sheave and an end of the umbilical upper portion may be fastened to the shearable connection 63. The frame may have a platform for the termination head 60 to rest. The umbilical lower portion 62 may be coiled and have a first end fastened to the shearable connection 63 and a second end fastened to the termination head 60. The load line 61 may extend through the load sheave and have an end fastened to the lifting lugs of the termination head 60, such as via a sling. Pivoting of the A-frame boom 53 relative to the platform by the piston and cylinder assemblies may lift the termination head 60 from the platform, over a rail of the vessel 75, and to a position over the waterline 1*w*. The load winch 55 may then be operated to lower the umbilical 65 and termination head 60 into the sea 1.

A length of the umbilical lower portion 62 may be sufficient to provide slack to account for vessel heave. A length of the umbilical lower portion 62 may also be sufficient so that the shearable connection 63 is at or slightly above a depth of a top of the wireline module 22. A length of the load line 56 may correspond to the length of the umbilical lower portion 62. As the load winch 55 lowers the termination head 60, the umbilical lower portion 62 may uncoil and be deployed into the sea 1 until the shearable connection 63 is reached. Once the shearable connection 63 is reached, a clump weight 64 may be fastened to a lower end of the umbilical upper portion 61. The termination head 60 may continue to be lowered using the load winch 55 until the shearable connection 63 and clump weight 64 are deployed from the LARS platform to over the waterline 1*w*. The umbilical winch 61 may then be operated to support the termination head 60 using the umbilical 65 and the load line 56 slacked. The load line 56 and sling may be disconnected from the termination head 60 by the ROV 80. Alternatively, the load line 56 may be wireline and the sling may have an actuator in communication with the wireline so that the van operator may release the sling. The termination head 60 may then be lowered to a landing depth (clump weight 64 and shearable connection 63 at or above top of wireline module 22) using the umbilical winch 52.

FIG. 2C illustrates deployment and connection of the supply fluid conduit 70 to the PCA 20. The PCA 20 may be deployed with the latch in the disengaged position. Alternatively, the ROV 80 may operate the actuator to disengage the latch after the PCA 20 has landed. As the umbilical 65 is being lowered to the landing depth, the ROV 80 may grasp the termination head and assist in landing the termination head in the termination receptacle. Once landed, the ROV 80 may engage the receptacle latch with the termination head 60. The ROV 80 may then connect the jumper 66*a* to the termination receptacle and tree control panel and the fluid conduit 76*a* to the outtake manifold 24*o* and tree annulus passage. The operator in the control van 51 may then close then close the tree valves 18*p,u,b* and the SSV 7*v* via the umbilical 65.

An upper portion of each fluid conduit 70 may be coiled tubing 71. The vessel 75 may further include a coiled tubing unit (CTU, not shown) for each fluid conduit 70. Each CTU may include a drum having the coiled tubing 71 wrapped therearound, a gooseneck, and an injector head for driving the coiled tubing 71, controls, and an HPU. Alternatively, each CTU may be electrically powered. A lower portion of each fluid conduit 70 may include a hose 72. The hose 72 may be made from a flexible polymer material, such as a thermoplastic or elastomer or may be a metal or alloy bellows. The hose 72 may or may not be reinforced, such as by metal or alloy cords. An upper end of the hose 72 may be connected to the coiled tubing 71 by a passive dry beak connection 47*p* and a lower end of the hose 72 may have a male coupling (of the respective actuated dry-break connection 47*a,b*) connected thereto. The hose 72 may include two or more sections (only one section shown), each section fastened together, such as by a flanged or threaded connection. During deployment of the fluid conduit 70, a clump weight 73 may be fastened to the lower end of the coiled tubing 71.

The lower portion 72 of the fluid conduit 70 may be assembled on the vessel 75 and deployed into the sea 1 using the CTU. The coiled tubing 71 may be deployed until the clump weight 73 and passive dry break connection 47*p* are at or slightly above a depth of a top of the wireline module 22. The ROV 80 may then grasp the male coupling of the actuated connection 47*a* and guide the coupling to the PCA manifold. A length of the hose 72 may be sufficient to provide slack in the fluid coupling 70 to account for vessel heave. The van operator may operate the dry break connection 47*a* actuator to the unlocked position. The ROV 80 may then insert the male coupling into the female coupling and the van operator may lock the connection 47*a*. The operation may then be repeated for the return fluid conduit.

An emergency disconnect system (EDS) may include the shearable fasteners, dry break connections 47*a,b,p*, the shearable connection 63, the clump weights 64, 73, and the lower portions 62, 72. The EDS may allow the vessel 75 to drift or drive off in the event of a minor or major emergency (see FIGS. 5B and 5C of the '596 application and the accompanying discussion thereof).

FIG. 2D illustrates deployment of the PRT 21 and wireline module 22 to the subsea production tree 15. A more detailed view of the wireline module 22 and PRT 21 may be found at FIGS. 3A-3C and 7A-7D of US Pat. App. Pub. No. 2012/0043089, filed Aug. 15, 2011 , which is herein incorporated by reference in its entirety. The wireline module 22 may include an adapter, a fluid sub, an isolation valve, one or more stuffing boxes, a grease injector, a frame, a control relay, an interface, such as a junction plate, a tool catcher, a grease reservoir, and a grease pump. The adapter, fluid sub, isolation valve, stuffing boxes, grease injector, and tool catcher may each include a housing or body having a longitudinal bore therethrough and be connected, such as by flanges, such that a continuous bore is maintained therethrough.

The adapter may include a connector for mating with the PCA connector profile, thereby fastening the wireline module 22 to the PCA 20. The connector may be dogs or a collet. The adapter may further include a seal face or sleeve and a seal (not shown). The adapter may further include an actuator (not shown), such as a piston and a cam, for operating the connector. The adapter may further include an ROV interface (not shown) so that the ROV 80 may connect to the connector, such as by a hot stab, and operate the connector actuator. Alternatively, the adapter may have the connector profile instead of the connector and the PCA tool housing may have the connector in communication with the subsea control system for operation by the van operator. The fluid sub may include a housing having a bore therethrough and a port in communication with the bore. The port may be in fluid communication with the junction plate via a conduit (not shown). The frame may be fastened to the adapter and the relay and interface may be fastened to the frame. The grease pump and reservoir may also be fastened to the frame.

The isolation valve may include a housing, a valve member disposed in the housing bore and operable between an open position and a closed position, and an actuator operable to move the valve member between the positions. The actuator may be electric or hydraulic and may be in communication with the control relay via a conduit (not shown). The actuator may fail to the closed position in the event of an emergency. The isolation valve may be further operable to cut wireline 91 when closed or the wireline module 22 may further include a separate wireline cutter. The isolation valve may further operate as a check valve in the closed position: allowing fluid flow downward from the stuffing box toward the PCA 20 and preventing reverse fluid flow therethrough.

Each stuffing box may include a seal, a piston, and a spring disposed in the housing. A port may be formed through the housing in communication with the piston. The port may be connected to the control relay via a hydraulic conduit (not shown). When operated by hydraulic fluid, the piston may longitudinally compress the seal, thereby radially expanding the seal inward into engagement with the wireline 91. The spring may bias the piston away from the seal and be set to balance hydrostatic pressure. Alternatively, an electric actuator may be used instead of the piston.

The grease injector may include a housing integral with each stuffing box housing and one or more seal tubes. Each seal tube may have an inner diameter slightly larger than an outer diameter of the wireline 91, thereby serving as a controlled gap seal. An inlet port and an outlet port may be formed through the grease injector/stuffing box housing. A grease conduit (not shown) may connect an outlet of the grease pump with the inlet port and another grease conduit (not shown) may connect the outlet port with the grease reservoir. Another grease conduit (not shown) may connect an inlet of the pump to the reservoir. Alternatively, the outlet port may discharge into the sea 1. The grease pump may be electrically or hydraulically driven via cable/conduit (not shown) connected to the control relay and may be operable to pump grease (not shown) from the grease reservoir into the inlet port and along the slight clearance formed between the seal tube and the wireline 91 to lubricate the wireline, reduce pressure load on the stuffing box seals, and increase service life of the stuffing box seals. The grease reservoir may be recharged by the ROV 80.

The tool catcher may include a piston, a latch, such as a collet, a stop, a piston spring, and a latch spring disposed in a housing thereof. The collet may have an inner cam surface for engagement with a fishing neck of the PRT 21 and/or BHA and the catcher housing may have an inner cam surface for operation of the collet. The latch spring may bias the collet toward a latched position. The collet may be movable from the latched position to an unlatched position either by engagement with a cam surface of the fishing neck and relative longitudinal movement of the fishing neck upward toward the stop or by operation of the piston. Once the cam surface of the fishing neck/BHA has passed the cam surface of the collet, the latch spring may return the collet to the latched position where the collet may be engagable with a shoulder of the fishing neck, thereby preventing longitudinal downward movement of the PRT/BHA relative to the catcher. The catcher housing may have a hydraulic port formed through a wall thereof in fluid communication with the piston. A hydraulic conduit (not shown) may connect the hydraulic port to the control relay. The piston may be biased away from engagement with the collet by the piston spring. When operated, the piston may engage the collet and move the collet upward along the housing cam surface and into engagement with the stop, thereby moving the collet to the unlatched position. Alternatively, an electric actuator may be used instead of the piston.

The PRT 21 may be tubular and include a stroker, an electric pump, a cablehead, an anchor, and a latch. The stroker, electric pump, cablehead, and anchor, may each include a housing or body connected, such as by threaded connections. The stroker may include the housing and a shaft. The cablehead may include an electronics package (not shown) for controlling operation of the PRT 21. The electronics package may include a programmable logic controller (PLC) having a transceiver in communication with the wireline 91 for transmitting and receiving data signals to the vessel 75. The electronics package may also include a power supply in communication with the PLC and the wireline 91 for powering the electric pump, the PLC, and various control valves. The electric pump may include an electric motor, a hydraulic pump, and a manifold. The manifold may be in fluid communication with the various PRT 21 components and include one or more control valves for controlling the fluid communication between the manifold and the components. Each control valve actuator may be in communication with the PLC. The cablehead may connect the PRT 21 to the wireline module 22, such as by engagement of a shoulder with a corresponding shoulder formed in the stop. The anchor may include two or more radial piston and cylinder assemblies and a die connected to each piston or two or more slips operated by a slip piston.

The latch may include a housing. The housing may be fastened to the shaft, such as by a threaded connection. The latch may further include a gripper, such as a collet, connected to an end of the housing. The latch may further include a locking piston disposed in a chamber formed in the housing and operable between a locked position in engagement with the collet and an unlocked position disengaged from the collet. The locking piston may be biased toward the locked position by a biasing member, such as a spring. The locking piston may be in fluid communication with the stroker pump via a passage formed through the housing, a passage (not shown) formed through the shaft and via a hydraulic swivel (not shown) disposed between the stroker housing and shaft.

The latch may further include a release piston disposed in a chamber formed in the housing and operable between an extended position in engagement with a body of the crown plug 17*u* and retracted position so as not to interfere with operation of the collet. The release piston may be biased toward the retracted position by a biasing member, such as a spring. The release piston may also be in fluid communication with the stroker pump via a passage formed through the housing, a second passage (not shown) formed through the shaft and via the hydraulic swivel (not shown) disposed between the stroker housing and shaft. The release piston may also serve as a landing shoulder. The release piston may include a contact sensor or switch (not shown) in fluid or electrical communication with the PLC via a port or leads (not shown) extending through the housing to the shaft and from the shaft to the stroker housing via the swivel. Alternatively, flexible conduit and/or flexible cable may be used instead of the hydraulic swivel.

FIG. 2E illustrates connection of the wireline module 22 to the PCA 20. To prepare for the abandonment operation, the wireline 91 may be fed through the tower 78 and inserted through the wireline module 22 and connected to the PRT 21. The PRT 21 may then be connected to the tool catcher. The wireline module 22 may then be deployed through the moonpool 77 using the wireline winch 76 and landed on the PCA tool housing. The ROV 80 may operate the adapter connector, thereby fastening the wireline module 22 to the PCA 20. The ROV 80 may then connect jumper 66*b* to the termination receptacle and control relay and connect fluid conduit 76*a* to the intake manifold 24*i* and the junction box. The van operator may then engage one or both of the stuffing boxes with the wireline 91. The van operator may then release the PRT 21 from the tool catcher via the umbilical 65 and control relay.

The van operator may then supply electrical power to the PRT 21 via the wireline 91 and operate the PRT to remove the crown plugs 17*u,b*. More detail regarding operation of the PRT 21 may be found at FIGS. 4C-4H of the '089 published application. A tree saver (not shown) may or may not then be installed in the production tree 15 using a modified PRT (see FIGS. 5A-5D of the '089 published application).

Figures 3A, 3B:
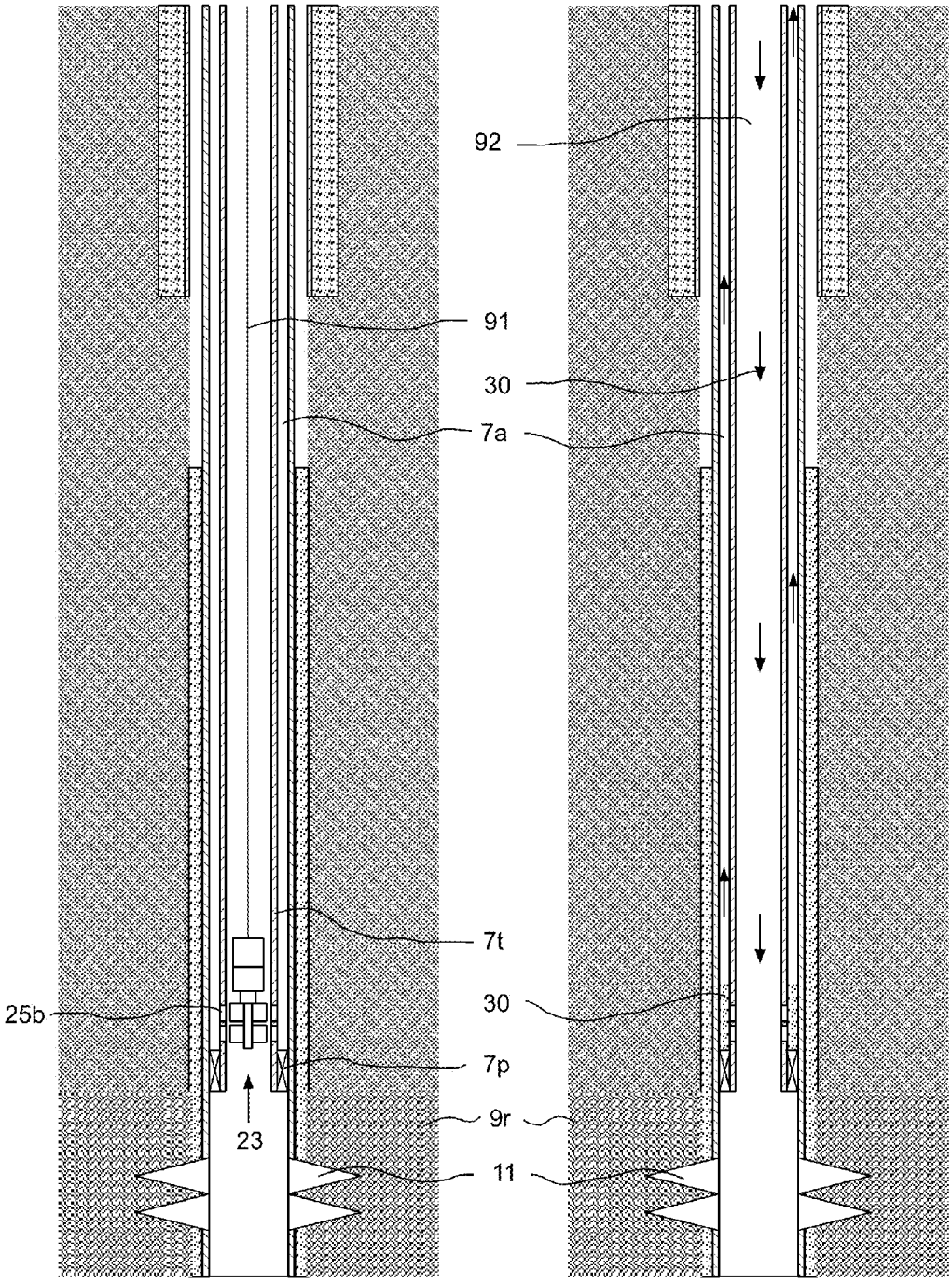
FIGS. 3A-3J illustrate abandonment of a lower portion of the wellbore, according to one embodiment of the present invention.
Figure 3C:
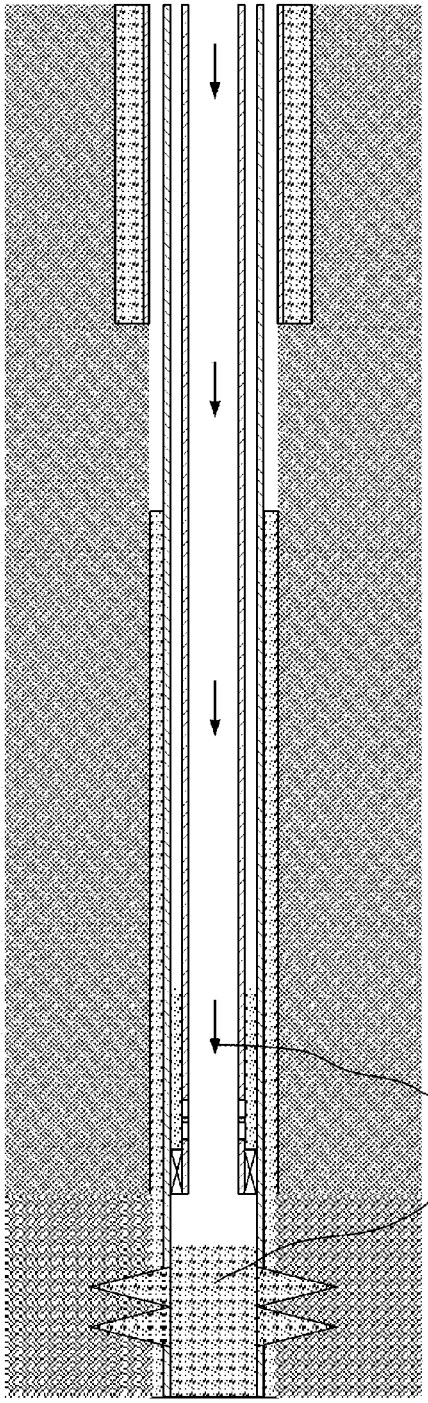

FIGS. 3A-3J illustrate abandonment of a lower portion of the wellbore 2, according to one embodiment of the present invention. FIGS. 3A-3C illustrate cement plugging of a lower portion of the tubing annulus 7*a* and the reservoir 9*r*. Once the crown plugs 17*u,b* have been removed from the tree 15, the BHA 23 may be connected to the wireline 91 and wireline module 22 and deployed to the PCA 20. The BHA 23 may include a cablehead, a collar locator, and a perforator, such as a perforating gun. The cablehead, collar locator, and perforating gun may be connected together, such as by threaded connections or flanges and studs or bolts and nuts. The perforating gun may include a firing head and a charge carrier. The charge carrier may include a housing, a plurality of shaped charges, and detonation cord connecting the charges to the firing head. The firing head may receive electricity from the wireline 91 to operate an electric match thereof. The electric match may ignite the detonation cord to fire the shaped charges. Alternatively, the perforator may be a mechanically or hydraulically operated tubing punch.

Once the wireline module 22 has landed on the PCA 20, the SSV 7*v* may be opened and the BHA 23 may be deployed into the wellbore 2 using the wireline 91. The BHA 23 may be deployed to a depth adjacent to and above the production packer 7*p*. Once the BHA 23 has been deployed to the setting depth, electricity may then be supplied to the BHA via the wireline 91 to fire the perforating guns into the production tubing 7*t*, thereby forming lower perforations 25*b* through a wall thereof. The BHA 23 may be retrieved to the wireline module 22 and the wireline module dispatched from the PCA 20 to the vessel 75. The van operator may then open the lower annulus valve 18*b* and close the PCA isolation valve.

Cement slurry 30 may then be pumped from the vessel 75, through the supply fluid conduit 70 and the PCA fluid sub port, down the production tree 15 (with tree saver) and production tubing 7*t*, and into the tubing annulus 7*a* via the lower perforations 25*b*. Wellbore fluid displaced by the cement slurry 30 may flow up the tubing annulus 7*a*, through the wellhead 10, tree annulus port, and to the vessel 75 via the return conduit. Once a desired quantity of cement slurry 30 has been pumped into the tubing annulus 7*a*, the van operator may close the lower annulus valve 18*b* while continuing to pump cement slurry, thereby squeezing cement slurry into the formation. Once pumped, the cement slurry 30 may be allowed to cure for a predetermined amount of time, such as one hour, six hours, twelve hours, or one day, thereby forming a lower cement plug 31*b*.

The cement slurry 30 may be Portland cement slurry or geopolymer cement slurry. The cement slurry 30 may be pumped in as part of a fluid train including a leading conditioner fluid, the cement slurry, and a trailing displacement fluid. The fluid train may be used to displace the wellbore fluid from the annulus and densities of the train fluids may correspond so that the cement slurry 30 in the tubing annulus 7*a* is in a balanced condition.

Alternatively, the cement slurry may be pumped in as a resin, diluent, and hardener and cure to form a viscoelastic polymer, as discussed and illustrated in US Pat. App. Pub. No. 2011/0203795, filed Feb. 24, 2010 , which is herein incorporated by reference in its entirety. Alternatively the cement slurry may be pumped as a multi-layer cement slurry including one or more layers of Portland or geopolymer cement and a layer of the resin, diluent, and hardener, also discussed and illustrated in the '795 publication.

Figure 3D:
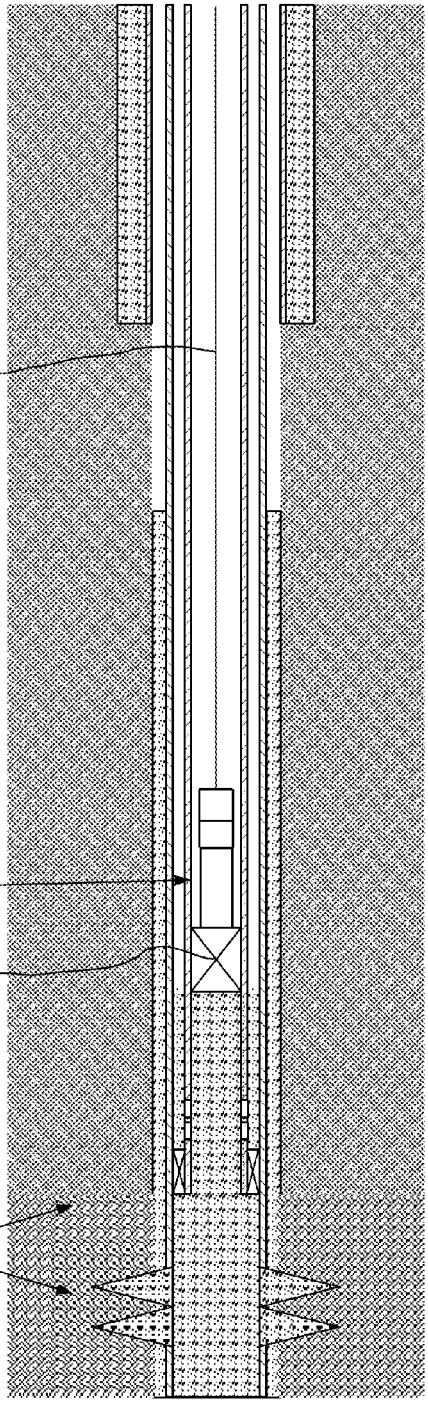

FIG. 3D illustrates setting a lower bridge plug 32*b* in the production tubing 7*t*. Once the lower cement plug 31*b* has cured, a second BHA 26 may be connected to the wireline 91 and wireline module 22 and deployed to the PCA 20. The second BHA 26 may include a cablehead, a collar locator, a setting tool, and the lower bridge plug 32*b*. The setting tool may include a mandrel and a piston longitudinally movable relative to the mandrel. The setting mandrel may be connected to the collar locator and fastened to a mandrel of the lower bridge plug 32*b*, such as by shearable pins, screws, or ring. The setting tool may include a firing head and a power charge. The firing head may receive electricity from the wireline 91 to operate an electric match thereof and fire the power charge. Combustion of the power charge may create high pressure gas which exerts a force on the setting piston. The bridge plug 32*b* may include a mandrel, an anchor, and a packing. The anchor may and packing may be disposed along an outer surface of the plug mandrel between a setting shoulder of the mandrel and a setting ring. The setting piston may engage the setting ring and drive the packing and anchor against the setting shoulder, thereby setting the lower bridge plug 32*b*.

The second BHA 26 may be deployed to a depth adjacent to and above the lower cement plug 31*b*. Once the second BHA 26 has been deployed to the setting depth, electricity may then be supplied to the second BHA via the wireline 91 to fire the setting tool, thereby expanding the lower bridge plug 32*b* against an inner surface of the production tubing 7*t*. Once the lower bridge plug 32*b* has been set, the plug may be released from the setting tool by exerting tension on the wireline 91 to fracture the shearable fasteners. The second BHA 26 may then be retrieved to the wireline module 22 and the wireline module dispatched from the PCA 20 to the vessel 75.

Figure 3E:
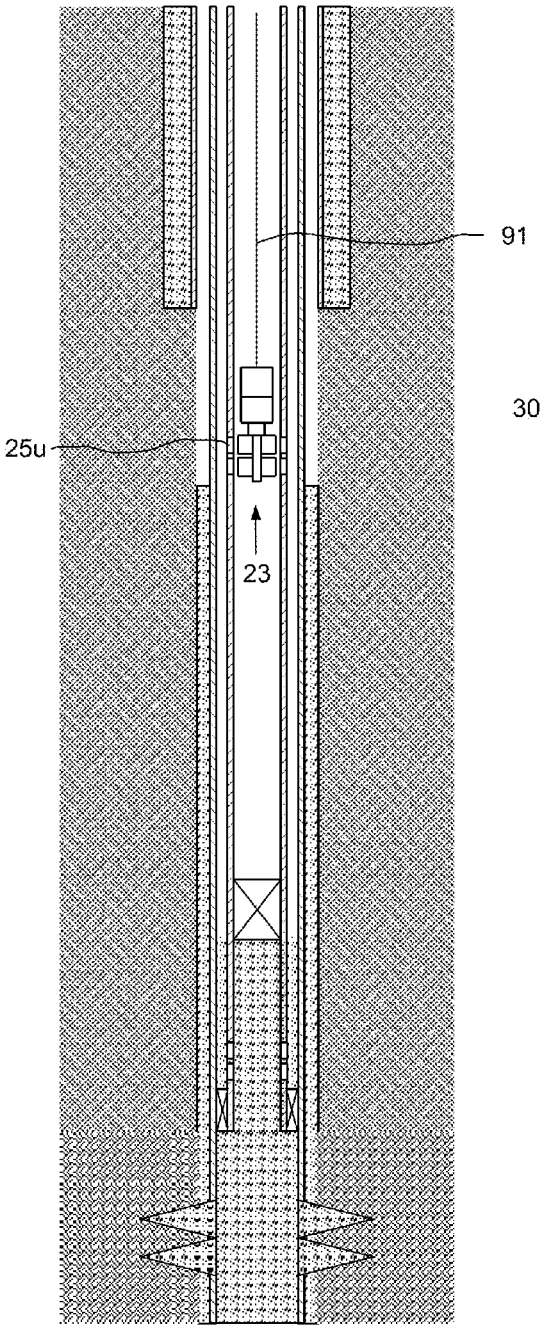
Figure 3F:
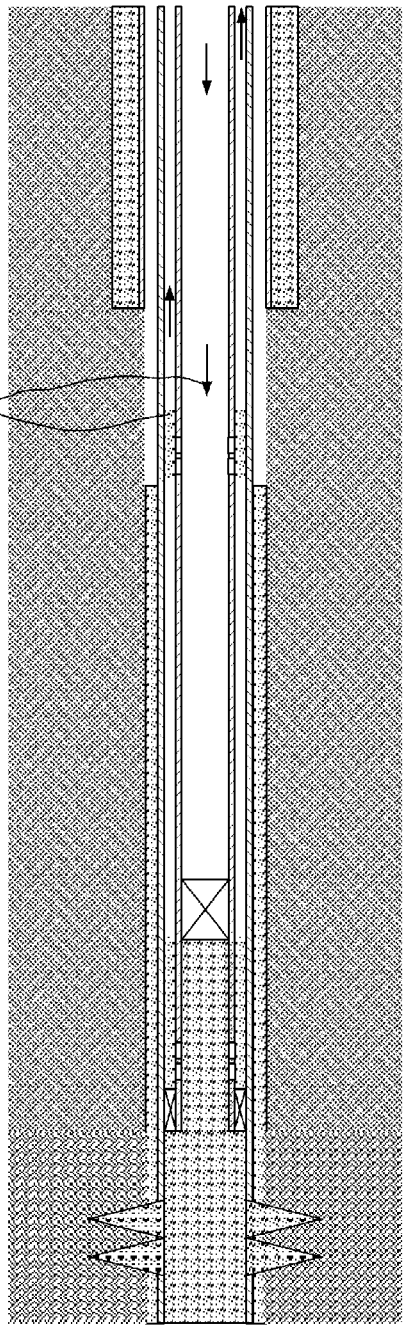

FIGS. 3E and 3F illustrate cement plugging of an intermediate portion of the tubing annulus 7*a*. The BHA 23 may then be redeployed to the PCA 20 and into the wellbore 2 using the wireline 91. The BHA 23 may be redeployed to a depth below a shoe of the intermediate casing string 5 and above a top of the production casing cement 8*p*. Once the BHA 23 has been deployed to the setting depth, electricity may then be supplied to the BHA via the wireline 91 to fire the perforating guns into the production tubing 7*t*, thereby forming upper perforations 25*u* through a wall thereof. The BHA 23 may be retrieved to the wireline module 22 and the wireline module dispatched from the PCA 20 to the vessel 75.

Cement slurry 30 may then be pumped from the vessel 75, through the supply fluid conduit 70 and the PCA fluid sub port, down the production tree 15 (with tree saver) and production tubing 7*t*, and into the tubing annulus 7*a* via the upper perforations 25*u*. Wellbore fluid displaced by the cement slurry 30 may flow up the tubing annulus 7*a*, through the wellhead 10, tree annulus port, and to the vessel 75 via the return conduit. Once a desired quantity of cement slurry 30 has been pumped, the cement slurry 30 may be allowed to cure, thereby forming an intermediate cement plug 31*i*.

Figures 3G, 3H:
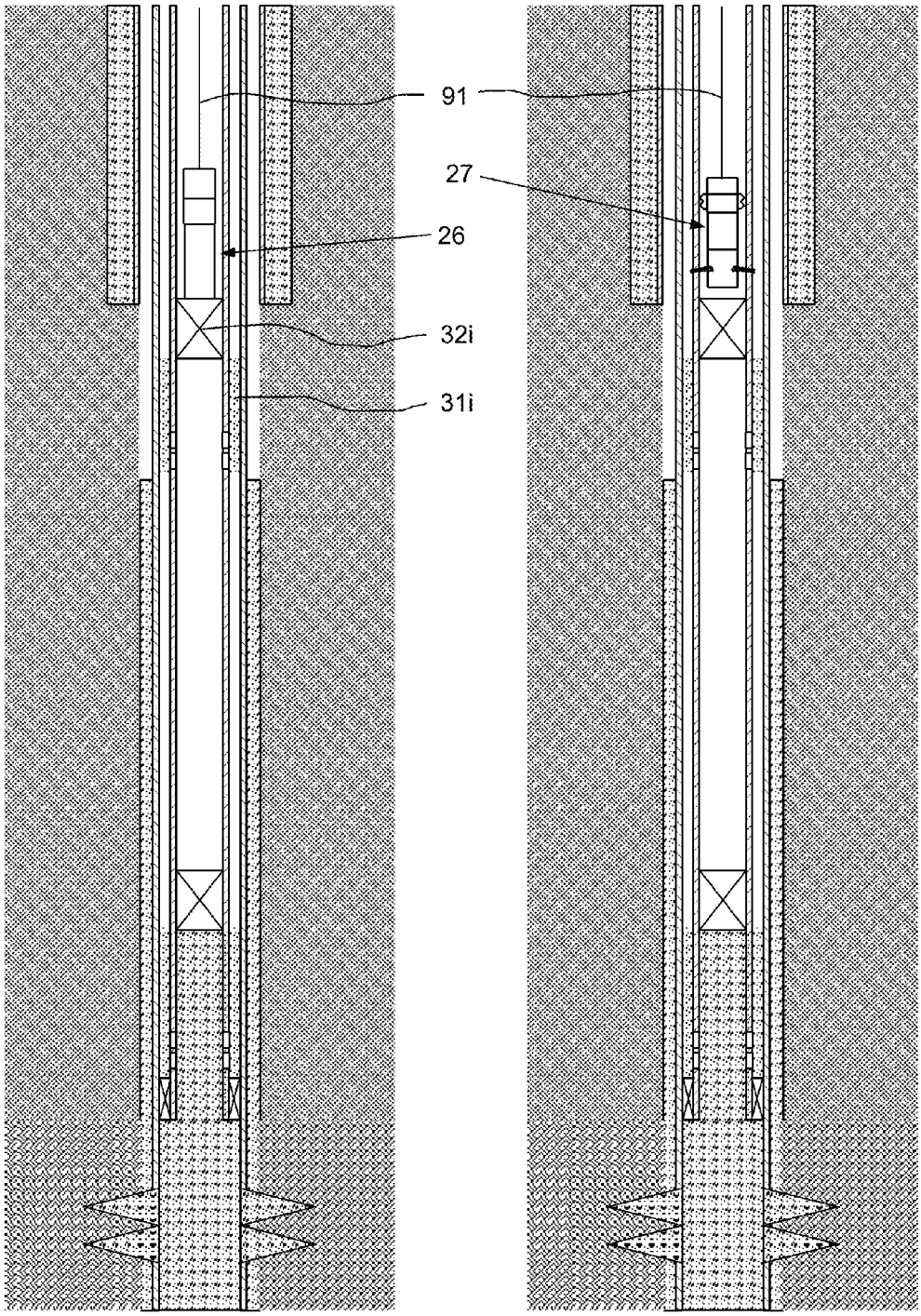

FIG. 3G illustrates setting an intermediate bridge plug 32*i* in the production tubing 7*t*. Once the intermediate cement plug 31*i* has cured, the second BHA 26 may be reconnected to the wireline 91 and wireline module 22 and redeployed to the PCA 20. The second BHA 26 may be redeployed to a depth adjacent to and above the intermediate cement plug 31*i*. Once the second BHA 26 has been deployed to the setting depth, the intermediate bridge plug 32*i* may be set against the inner surface of the production tubing 7*t*. Once the intermediate bridge plug 32*i* has been set, the plug may be released from the setting tool and the second BHA 26 may then be retrieved to the wireline module 22 and the wireline module dispatched from the PCA 20 to the vessel 75.

FIG. 3H illustrates cutting of the production tubing 7*t*. A third BHA 27 may be connected to the wireline 91 and wireline module 22 and deployed to the PCA 20. The third BHA 27 may include a cablehead, a collar locator, an anchor, an electric pump, a hydraulic fluid reservoir, a bypass valve, an electric motor, and a tubing cutter. The anchor may include two or more radial piston and cylinder assemblies and a die connected to each piston or two or more slips operated by a slip piston. The electric pump may be operable to supply hydraulic fluid from the reservoir to the casing cutter and to the anchor in response to receiving electricity from the wireline 91. Fluid pressure may extend blades of the tubing cutter into engagement with the production tubing 7*t* and extend the anchor into gripping engagement with the production tubing 7*t*. Once the blades and anchor have been extended, the electric motor may be operated to rotate the tubing cutter blades, thereby severing an upper portion of the production tubing 7*t* from a lower portion thereof. Once the production tubing has been cut, the bypass valve may be opened by supplying electricity via the wireline 91, thereby relieving hydraulic fluid from the anchor and tubing cutter to the reservoir. Alternatively, the tubing cutter may be a thermite torch.

The third BHA 27 may then be retrieved to the wireline module 22 and the wireline module dispatched from the PCA 20 to the vessel 75. Once the third BHA 27 and wireline module 22 have been retrieved to the vessel 75, the PCA 20 may be disconnected from the tree 15 and retrieved to the vessel.

Figure 3I:
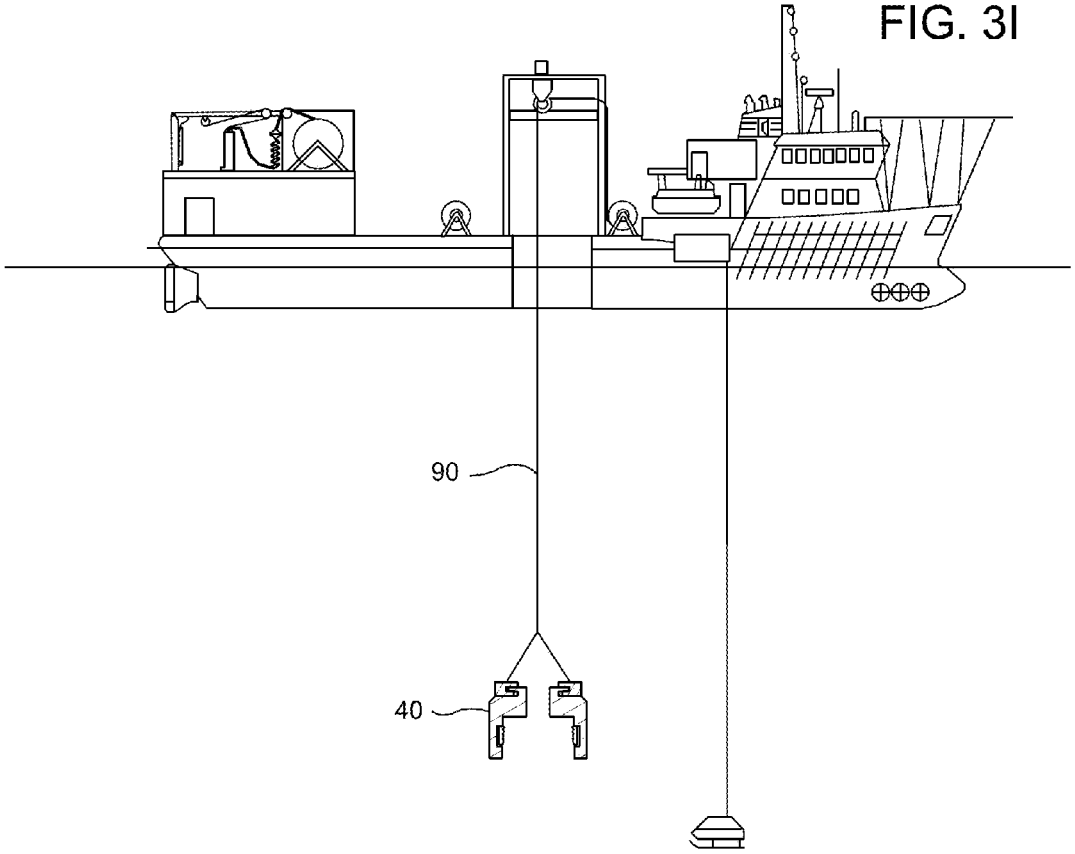
Figure 3I:
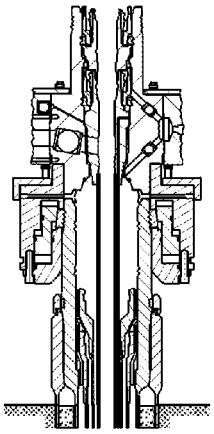
Figure 3J:
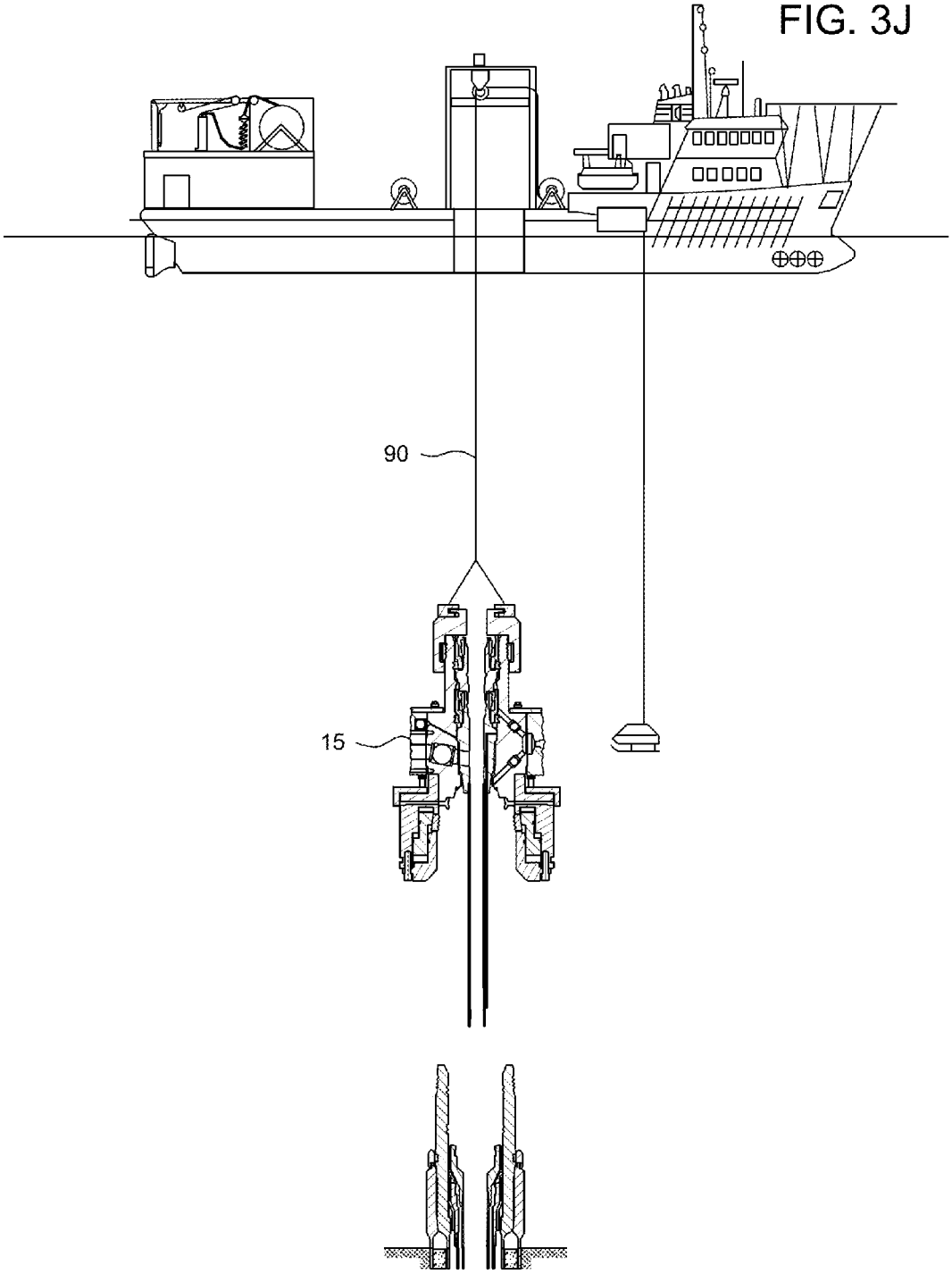

FIGS. 3I and 3J illustrate retrieval of the production tree 15. A tree grapple 40 may be connected to the wire rope 90 and lowered from the vessel 75 into the sea 1 via the moon pool 77. The ROV 80 may guide landing of the tree grapple 40 on the tree 15. The ROV 80 may then operate a connector of the tree grapple 40 to fasten the grapple to the tree 15. The ROV 80 may then disengage the tree connector 13 from the wellhead 10 and the production tree 15 and the severed upper portion of the production tubing 7 may be lifted to the vessel 75.

Figure 4A:
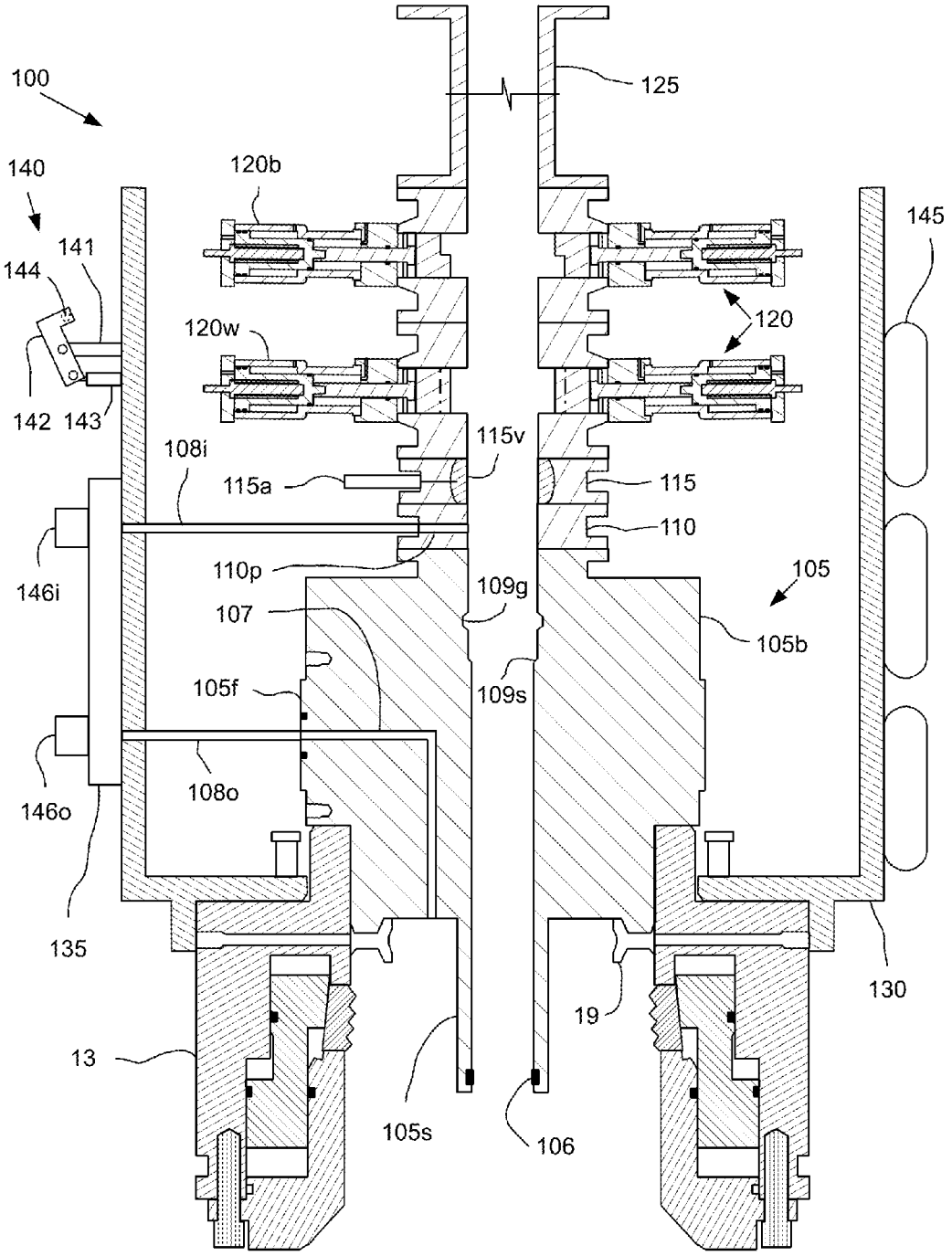
FIG. 4A illustrates a second PCA for connection to the subsea wellhead, according to another embodiment of the present invention.

FIG. 4A illustrates a second PCA 100 for connection to the subsea wellhead 10, according to another embodiment of the present invention. The second PCA 100 may include the tree connector 13 (and face seal 19), a wellhead adapter 105, a fluid sub 110, a solid barrier, such as isolation valve 115, a BOP stack 120, a tool housing 125, a frame 130, a manifold 135, a termination receptacle 140, one or more accumulators 145 (three shown), and a subsea control system. The fluid sub 110, isolation valve 115, BOP stack 120, tool housing 125, frame 130, manifold 135, termination receptacle 140 (having the base 141, the latch 142, the actuator 143, and the shearable fastener 144), accumulators 145, and subsea control system may be similar to those discussed above for the PCA 20. The frame 130 may be connected to the tree connector 13, such as by fasteners. The manifold 135 may include an inlet dry break coupling 146*i* and an outlet dry break coupling 146*o* and an actuated valve (not shown) for each coupling. Each dry break coupling 146*i,o* may be similar to the dry break coupling discussed above for the dry break connection 47*a*.

The wellhead adapter 105 may include a housing or body 105*b* having a longitudinal bore therethrough and couplings at each longitudinal end thereof. The upper coupling may be a flange for connection to the isolation valve 115 and the lower coupling may be threaded for connection to the tree connector 13. The bore may have a large drift diameter, such as greater than or equal to four, five, six, or seven inches to accommodate an annulus cementing tool string 200 (FIGS. 5A-5G). The adapter body 105*b* may further have a seal sleeve 105*s*. A seal 106 may be connected to the seal sleeve 105*s* for sealing against the cementing tool string 200. The seal 106 may be directional, such as cup seal ring or a chevron seal ring. The directional seal 106 may be oriented to seal against the cementing tool string 200 in response to pressure in the wellhead 10 being greater than pressure in the second PCA bore. Alternatively, the seal sleeve 105*s* may be a separate member from the body and connected to the body 105*b*, such as by a threaded connection. Alternatively, the seal sleeve 105*s* may be omitted and the seal 106 located in the body.

The adapter body 105 may further include a seal face 105*f* formed in an exterior surface thereof. The adaptor body 105*b* may further have one or more flow passages 107 formed in a wall thereof. The flow passage 107 may provide fluid communication between the seal face 105*f* and a chamber 150 formed between the seal sleeve 105*s* and the wellhead housing 4*h* (FIG. 6B). A fluid conduit 108*o* may connect to the seal face 105*f* and the manifold 135 and provide fluid communication between the flow passage 107 and the outlet coupling 146*o* of outlet dry break connection 147*o* (FIG. 6B). Another fluid conduit 108*i* may connect to the fluid sub 110 and the manifold 135 and provide fluid communication between the fluid sub port 110*p* and the inlet dry break coupling 146*i* of inlet dry break connection 147*i* (FIG. 6B). The adapter body 105*b* may further include a landing profile 109*g,s* formed in an inner surface thereof for receiving a hanger 205 (FIG. 5A) of the annulus cementing tool string 200. The landing profile 109*g,s* may include a landing shoulder 109*s* and a latch profile, such as a groove 109*g*.

Figure 4B:
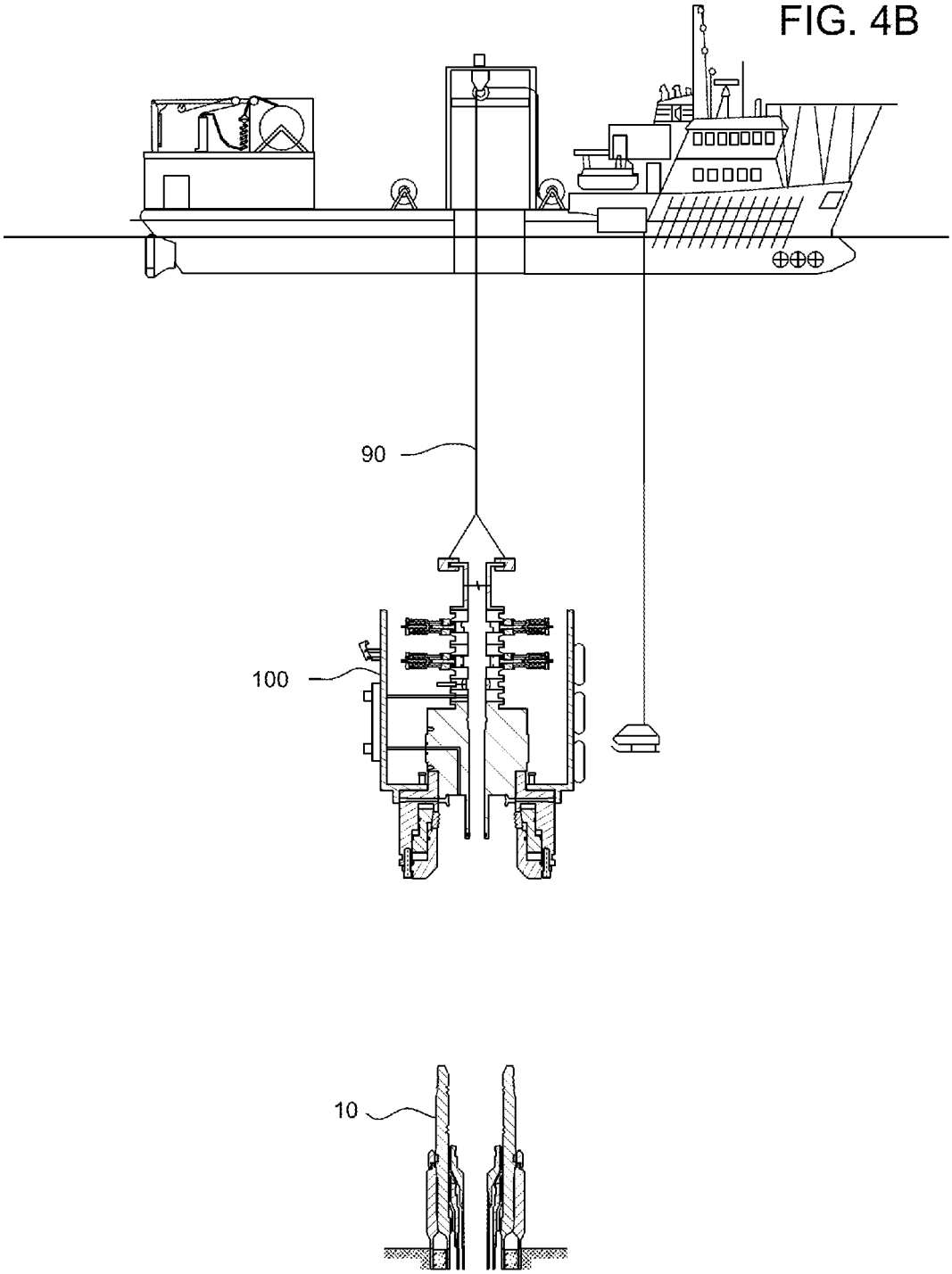
FIG. 4B illustrates deployment of the second PCA to the subsea wellhead.
Figure 4C:
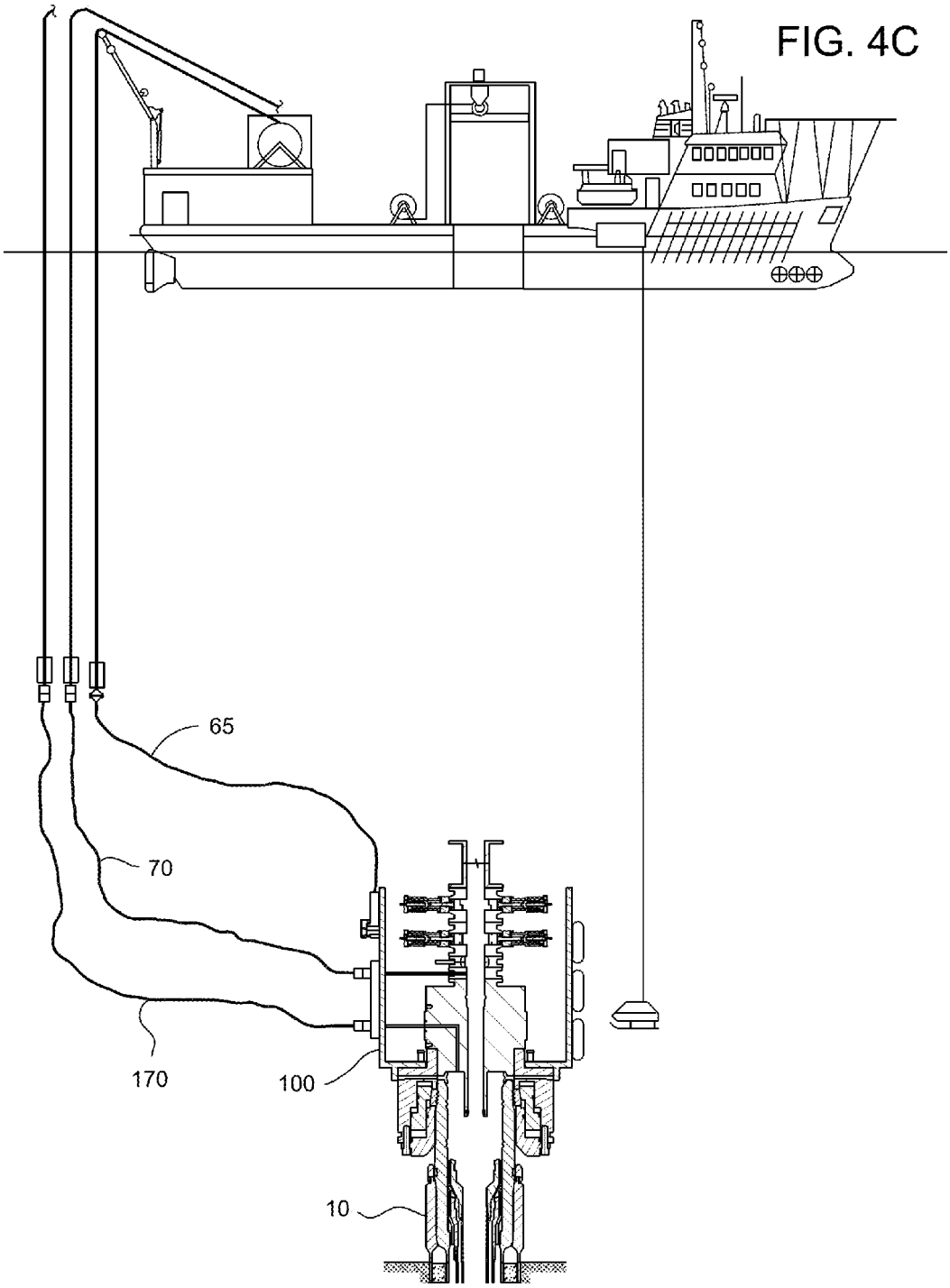
FIG. 4C illustrates connection of fluid conduits the umbilical to the second PCA.

FIG. 4B illustrates deployment of the second PCA 100 to the subsea wellhead 10. FIG. 4C illustrates connection of the supply fluid conduit 70, return fluid conduit 170, and umbilical 65 to the second PCA 100. Deployment of the second PCA to the wellhead 10 may be similar to deployment of the PCA 20 to the tree 15, discussed above. The return fluid conduit 170 may be similar to and deployed in a similar fashion as the fluid conduit 70, discussed above.

Figures 5A, 5B, 5C:
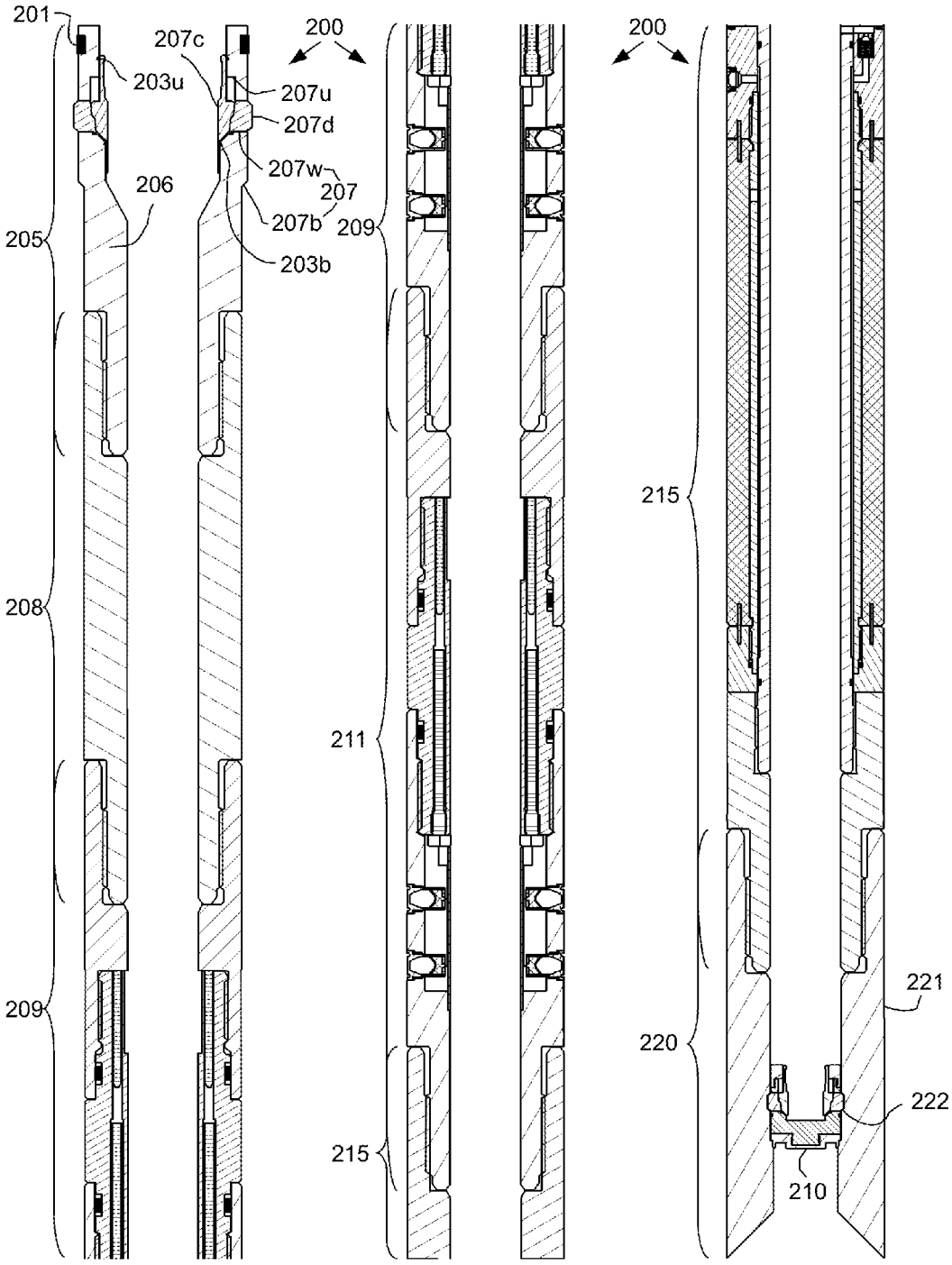
FIGS. 5A-5C illustrate an annulus cementing tool string, according to another embodiment of the present invention.

FIGS. 5A-5C illustrate the annulus cementing tool string 200, according to another embodiment of the present invention. The tool string 200 may include a hanger 205, an extender 208, one or more of perforators, such as perforating guns 209, 211, a packer, such as inflatable packer 215, and a shoe 220. The perforating guns 209, 211 may be disposed between the extender 208 and the inflatable packer 215. The shoe 220 may include a body 221 and a bore closure, such as a plug 210, fastened to the body. The body 221 may have a conical nose to guide retrieval of the BHA 23. The plug 210 may be a crown plug as discussed above for the tree 15. The plug 210 may be engaged with a profile 222 formed in an inner surface of the body 221, thereby sealing a bore of the tool string 200. Alternatively, a pressure relief device or lock open flapper valve may be used instead of the bore plug. Alternatively, the perforator 211 may be a mechanically or hydraulically operated tubing punch.

The hanger 205 may include a housing 206, a latch 207, and one or more seals 201, 203*u,b*. The housing 206 may be tubular and have a flow bore formed therethrough. A coupling, such as a threaded coupling, may be formed at a lower end of the housing 206 for connection with the extender 208. The seal 201 may be directional, such as cup seal ring or a chevron seal ring. The directional seal 201 may be oriented to seal against the PCA bore in response to pressure in the PCA bore greater than pressure in the wellhead 10. Alternatively, either of the seals 106, 201 may be omitted and/or be bidirectional. If the seal 106 is omitted, then the seal 201 may be carried by the hanger 205 and the seal sleeve 105*s* omitted or the seal 201 may be carried by the extender 208 for sealing against the seal sleeve 105*s*.

The latch 207 may be connected to the housing 206 at an upper end of the housing. The latch 207 may include an actuator, such as a cam 207*c*, and one or more fasteners, such as dogs 207*d*. The housing 206 may have a plurality of windows 207*w* formed through a wall thereof for extension and retraction of the dogs 207*d*. The dogs 207*d* may be pushed outward by the cam 207*c* to engage the adapter body groove 109*g*, thereby longitudinally connecting the hanger 205 to the adapter body 105. The cam 207*c* may be longitudinally movable relative to the housing 206 between an engaged position (shown) and a disengaged position (not shown). In the engaged position, the cam 207*c* may lock the dogs 207*d* in the extended position and in the disengaged position, the cam may be clear of the dogs, thereby freeing dogs to retract. The cam 207*c* may have an actuation profile formed in an outer surface thereof for pushing the dogs to the extended position, a gripping profile formed in an inner surface thereof for engagement with the PRT 21, and a stinger for maintaining engagement of the cam with a seal 203*b* regardless of the cam position. The cam 207*c* may also maintain engagement with the seal 203*u* regardless of the cam position. The latch 207 may further include an upper pickup shoulder 207*u* formed in an inner surface of the housing 206 and engaged with the cam 207*c* when the cam is in the disengaged position and a lower landing shoulder 207*b* formed in an outer surface of the housing 206 for seating against the adapter body landing shoulder 109*s*. The pickup shoulder 207*u* may be used for supporting the tool string 200 when carried by the PRT 21.

Alternatively, a packer similar to the bridge plugs discussed above may be used instead of the hanger.

Figures 5D, 5E, 5F:
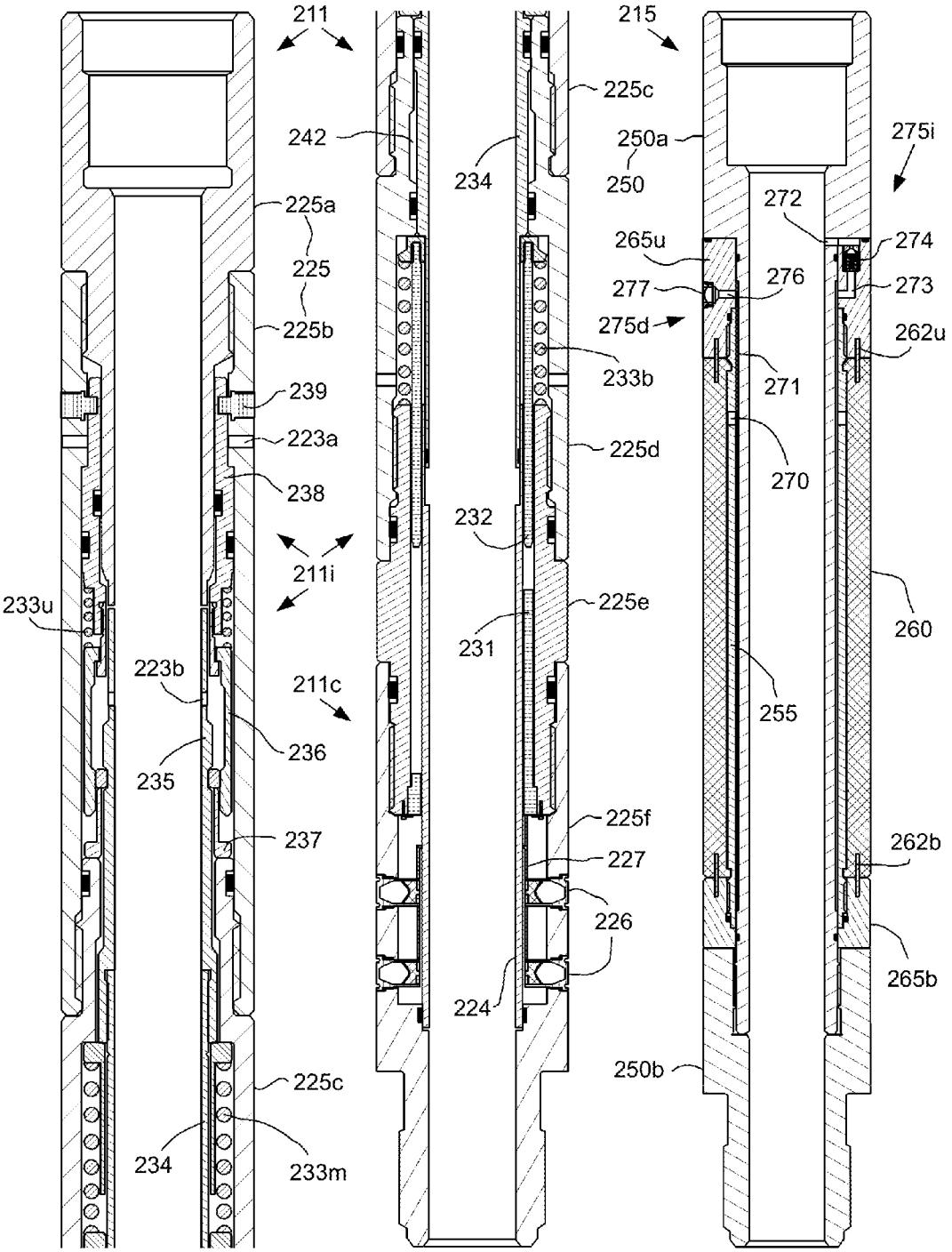
FIGS. 5D and 5E illustrate a perforating gun of the tool string.
FIG. 5F illustrates an inflatable packer of the tool string.

FIGS. 5D and 5E illustrate a perforating gun 211 of the tool string 200. The other perforating gun 209 may be similar except for having a greater charge strength and firing differential pressure. The perforating gun 211 may include an igniter 211*i* and a charge carrier 211*c*. The gun 211 may include a tubular housing 225 having a flow bore formed therethrough. To facilitate manufacture and assembly, the housing 225 may include two or more sections 225*a-f* connected together, such as by threaded couplings. The housing 225 may have a coupling, such as a threaded coupling, formed at each longitudinal end thereof for connection with the perforating gun 209 at the upper end and for connection with the packer 215 at the lower end. The housing 225 may also have one or more (two shown) annulus ports 223*a* formed through a wall of section 225*b*. The perforating gun 211 may further include various seals disposed between various interfaces thereof such that a bore thereof is isolated from an exterior thereof.

The charge carrier 211*c* may include a stinger 224 of housing section 225*e*, a housing section 225*f*, one or more shaped charges 226 and one or more detonation cords 227. The perforating gun 211 may include one or more (two shown) sets of shaped charges 226, each set having a plurality of shaped charges circumferentially spaced around the housing section 225*f*. The igniter 211*i* may include the housing sections 225*a-e*, a blasting cap 231, one or more (two shown) firing pins 232, one or more biasing members, such as springs 233*u,m,b* and atmospheric chamber 242, an actuation sleeve 234, a latch sleeve 235, a latch cam 236, a latch fastener, such as a split ring 237, a firing piston 238, one or more (two shown) shearable fasteners, such as screws 239. The latch sleeve 235 may have one or more (two shown) bore ports 223*b* formed through a wall thereof.

In operation, an upper face of the firing piston 238 may be in fluid communication with the annulus ports 223*a* and a lower face of the firing piston may be in fluid communication with the bore ports 223*b*. To fire the gun 211, pressure in an annulus 300*a* (FIG. 6B) formed between the tool string 200 and the production casing 6 and the wellhead chamber 150 may be increased via the return line 170 relative to bore pressure of the tool string 200. Once the annulus pressure has been increased to a predetermined firing pressure differential, the firing piston 238 may break the shear screws 239 and move downward into contact with the latch cam 236. The firing piston 238 may then push the latch cam 236 downward and out of engagement with the split ring 237. The split ring 237 may then be free to expand out of engagement with the latch sleeve 235 which also frees the connected actuation sleeve 234. Once the actuation sleeve 234 is freed, the atmospheric chamber 242 may snap the actuation sleeve downward. The actuation sleeve 234 may drive the firing pins 232 downward to strike the blasting cap 231. The blasting cap 231 may then ignite the detonation cords 227 which may fire the shaped charges 226.

The stinger 224 may engage a seal bore of the housing section 225*f* and a lower end of the actuation sleeve 234 may carry a seal such that a bore of the perforating gun 211 remains isolated from the annulus 300*a* even after the shaped charges 226 have fired.

FIG. 5F illustrates the inflatable packer 215. The packer 215 may include a mandrel 250, a sleeve 255, a bladder 260, and one or more retainers, such as nuts 265*u,b*, an inflator 275*i*, and a deflator 275*d*. The mandrel 250 may be tubular and have a flow bore formed therethrough. To facilitate manufacture and assembly, the mandrel 250 may include two or more sections 250*a,b* connected together, such as by threaded couplings. The mandrel 250 may have a coupling, such as a threaded coupling, formed at each longitudinal end thereof for connection with the perforating gun 211 at the upper end and for connection with the shoe 220 at the lower end. The packer 215 may further include various seals disposed between various interfaces thereof. The bladder assembly 255, 260, 265*u,b* may be connected to the mandrel 250, such as by entrapment between shoulders of the mandrel. Each nut 265*u,b* may be connected to the sleeve 255, such as by threaded couplings. Each nut 265*u,b* may have a groove formed therein for receiving respective reinforcement elements, such as spring bars 262*u,b*. The bladder 260 may be made from an elastomeric material, such as polyisoprene, neoprene, polyurethane, or an elastomer copolymer. The bladder 260 may be molded onto the assembled nuts 265*u*, sleeve 255, and spring bars 262*u,b*.

An inner surface of the bladder 260 may be in fluid communication with one or more (two shown) ports 270 formed through a wall of the sleeve 255. The ports 270 may provide fluid communication with an annular flow passage 271 formed between the sleeve 255 and the mandrel 250. The inflator 275*i* and deflator 275*d* may each be in fluid communication with the passage 271. The inflator 275*i* may include an inflation port 272 formed through a wall of the mandrel, an inflation passage 273 formed in the upper nut 265*u*, and a check valve 274 disposed in the inflation passage. The check valve 274 may be oriented to allow flow from the inflation port 272 to the annular passage 271 via the inflation passage but to prevent reverse flow therethrough, thereby maintaining inflation of the bladder 260. The deflator 275*d* may include a deflation port 276 formed through a wall of the upper nut 265*u* and a pressure relief device 277 disposed in the deflation port.

The pressure relief device 277 may include a rupture disk and a pair of flanges. The deflation passage 276 may have a first shoulder formed therein for receiving the flanges and be threaded. One of the flanges may be threaded for fastening the pressure relief device 277 to the upper nut 265*u*. The rupture disk may be metallic and have one or more scores formed in an inner surface thereof for reliably failing at a predetermined rupture pressure differential (relative to the annulus pressure). The rupture disk may be disposed between the flanges and the flanges connected together, such as by one or more fasteners. The flanges may carry one or more seals for preventing leakage around the rupture disk.

Alternatively, the upper mandrel section 250*a* may be connected to the lower mandrel section 250*b* by one or more shearable fasteners and the upper mandrel section may have the deflation port and a seal straddling the deflation port and isolating the deflation port from the passage 271. In this alternative, to deflate the packer, tension may be exerted on the tool string using the PRT 21 and wireline 91 until the shearable fasteners fracture, thereby releasing the upper mandrel section. The upper mandrel section may then move upward relative to the bladder and lower mandrel section until the deflation port is aligned with the passage, thereby allowing the inflation fluid to discharge from the passage into the tool string bore. The upper mandrel section may further have a shoulder which then engages a mating shoulder of the lower mandrel section, thereby reconnecting the mandrel sections. Alternatively, the tool string 200 may include a packer having a packing set by compression using a piston instead of the inflatable packer 215.

Figure 6A:
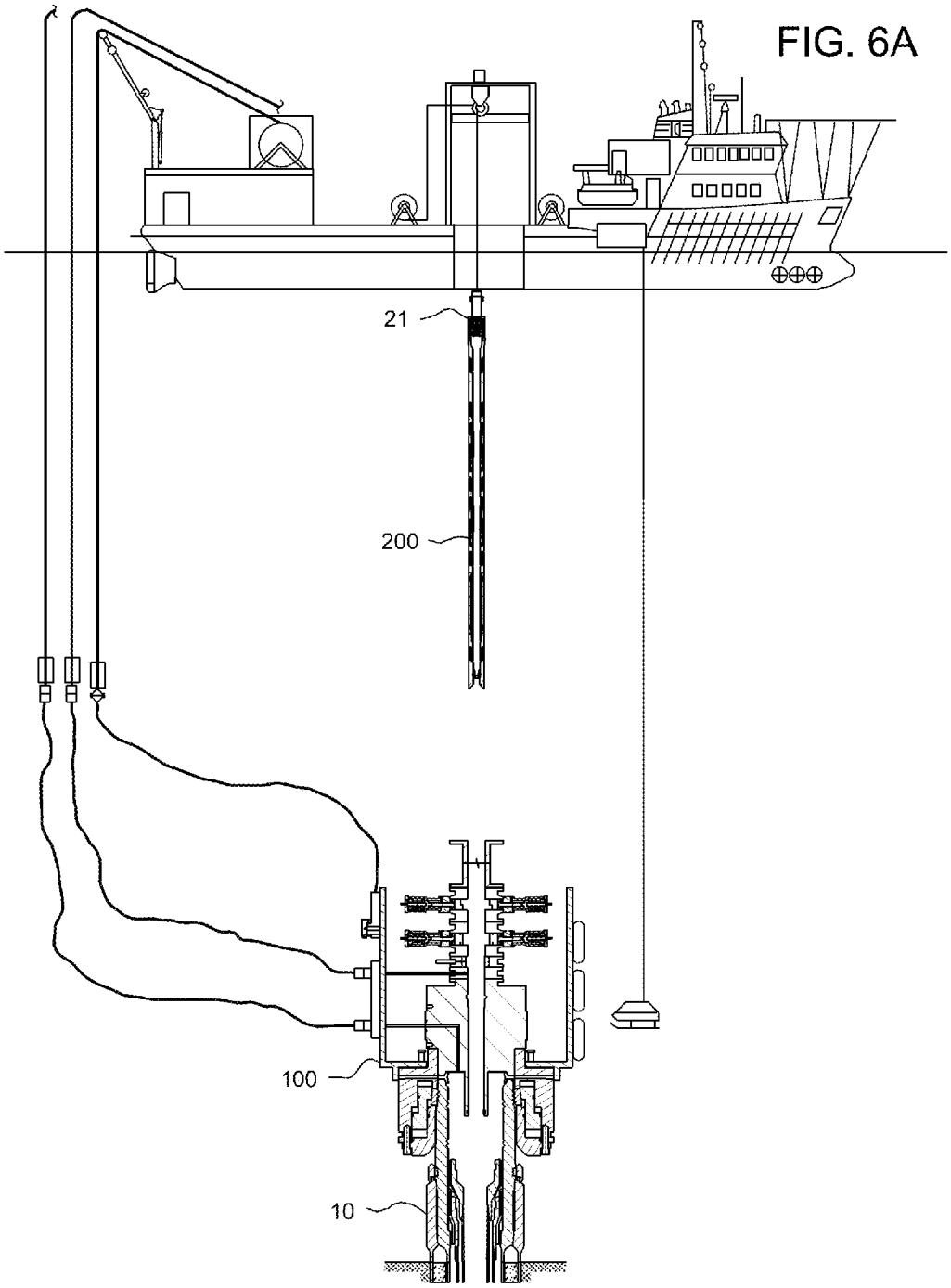
FIGS. 6A-6F illustrate deployment of the annulus cementing tool string to the subsea wellhead and installation in the second PCA.
Figure 6B:
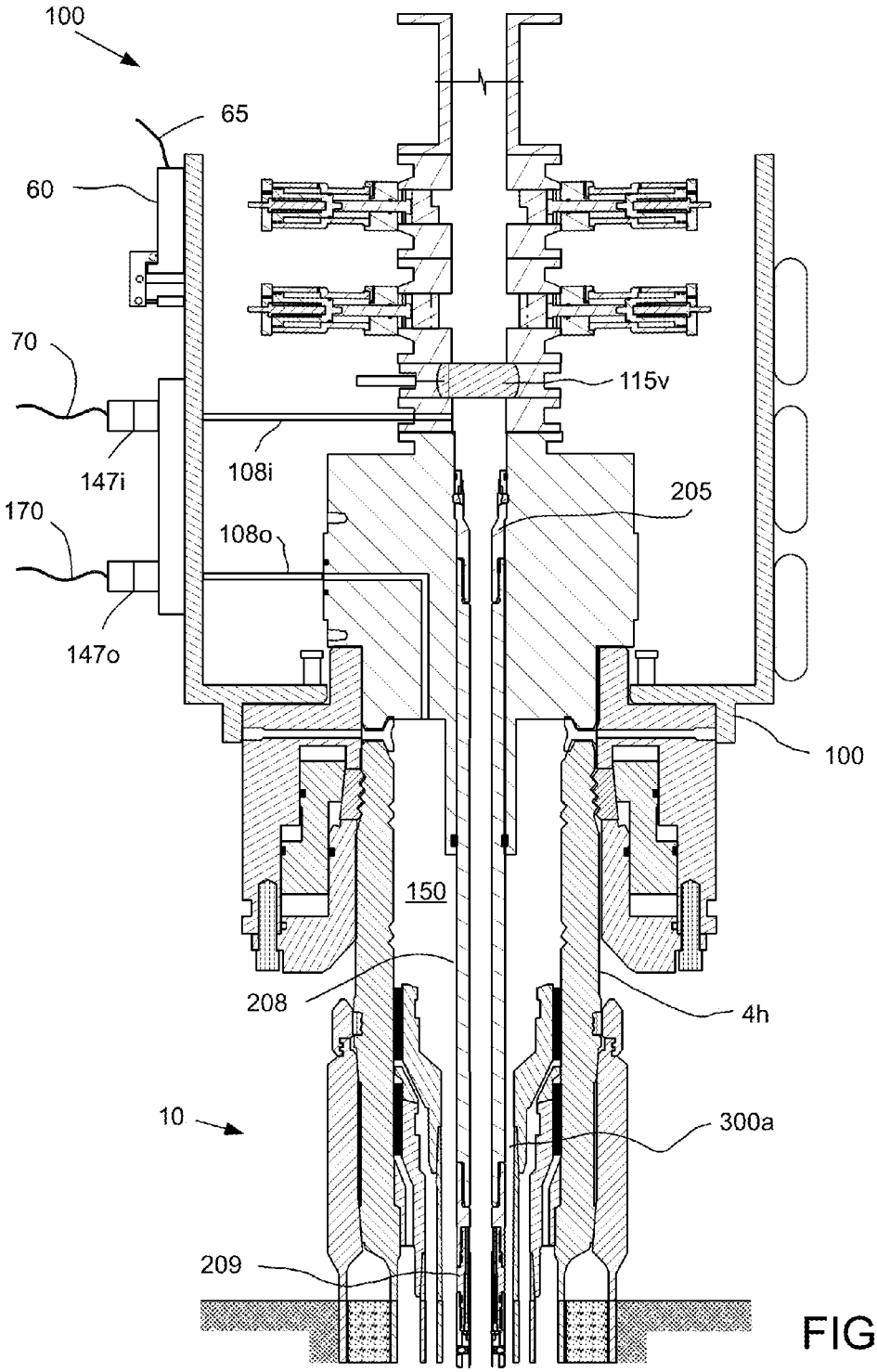

FIGS. 6A-6F illustrate deployment of the annulus cementing tool string 200 to the subsea wellhead 10 and installation in the second PCA 100. FIG. 6A illustrates deployment of the tool string 200 to the subsea wellhead 10 and the second PCA 100.

Figures 6C, 6D:
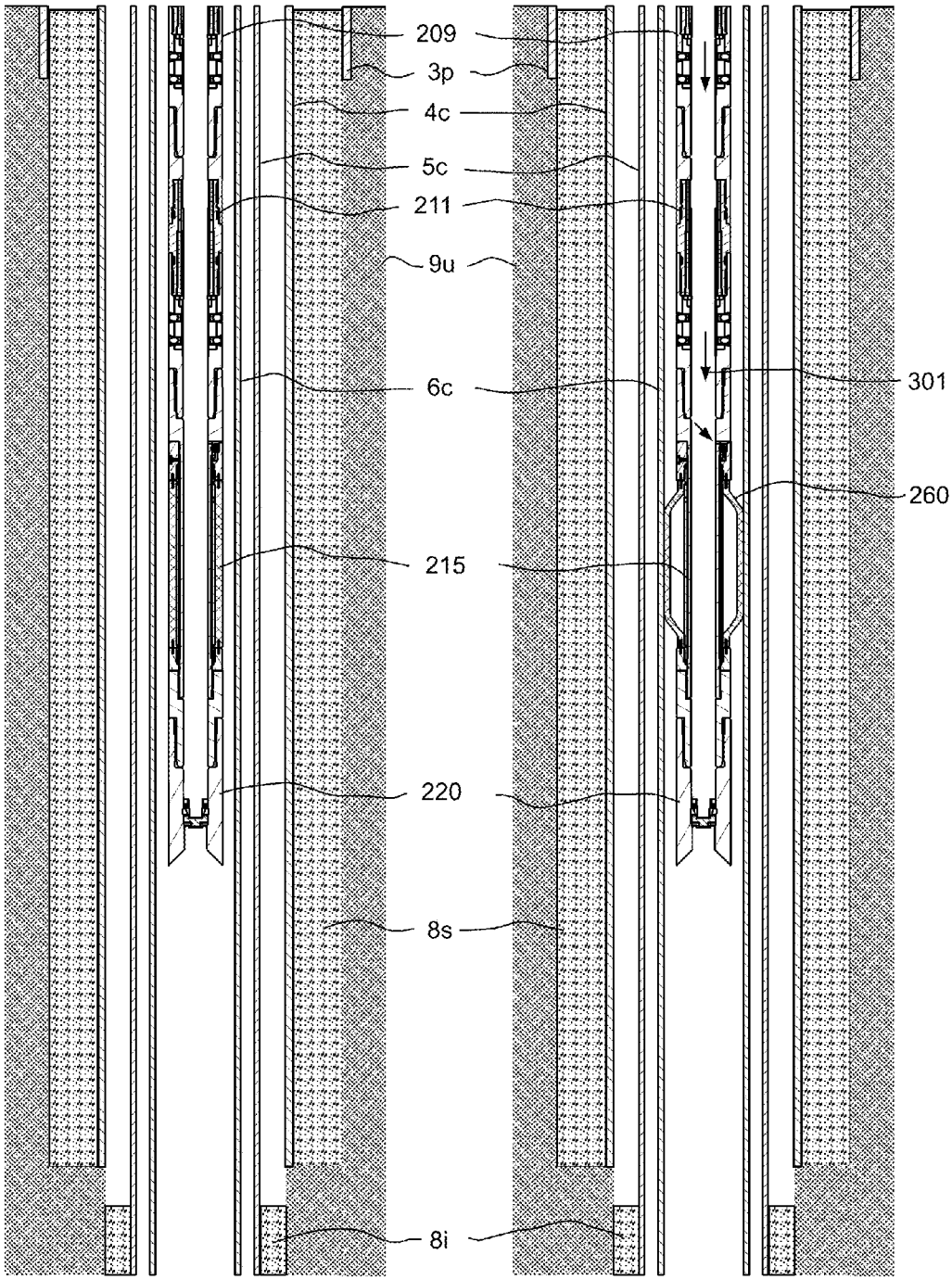

FIGS. 6B and 6C illustrate the tool string 200 landed in the second PCA 100. The tool string 200 may be filled with inflation fluid 301 (FIG. 6D). The wireline 91 may be connected to the PRT 21. The PRT 21 may then be connected to the hanger 205. The PRT 21 and tool string 200 may then be deployed through the moonpool 77 using the wireline winch 76 and landed in the second PCA 100. The van operator may then supply electricity to the PRT 21 via the wireline 91 and operate the PRT 21 to set the latch 207. The PRT 21 and wireline 91 may then be retrieved to the vessel 75. Alternatively, the PRT may be released by jarring up or down to mechanically set the latch 207. The isolation valve 115 may then be closed by the van operator via the umbilical 65 and subsea control system. Alternatively, one or more of the BOPS 120*b,w* may also be closed as a precautionary measure. Alternatively, the solid barrier may be a blind ram preventer, an annular blowout preventer (closed on itself), a check valve, or a plug instead of the isolation valve 115.

FIG. 6D illustrates inflating the packer 215. The inflation fluid 301 may be pumped from the vessel 75, down the supply fluid conduit 70, through the conduit 108*i* and fluid sub port 110*p*, and into the bore of the second PCA 100. The inflation fluid 301 may continue down the tool string bore to the inflator 275*i*. Pumping of the inflation fluid 301 against the bore plug 210 may increase pressure in the tool string bore, thereby opening the check valve 274. The inflation fluid 301 may continue through the open check valve 274, down the annular passage 271, and into the bladder chamber via the ports 270, thereby expanding the bladder 260 against an inner surface of the production casing 6*c*.

Figure 6E:
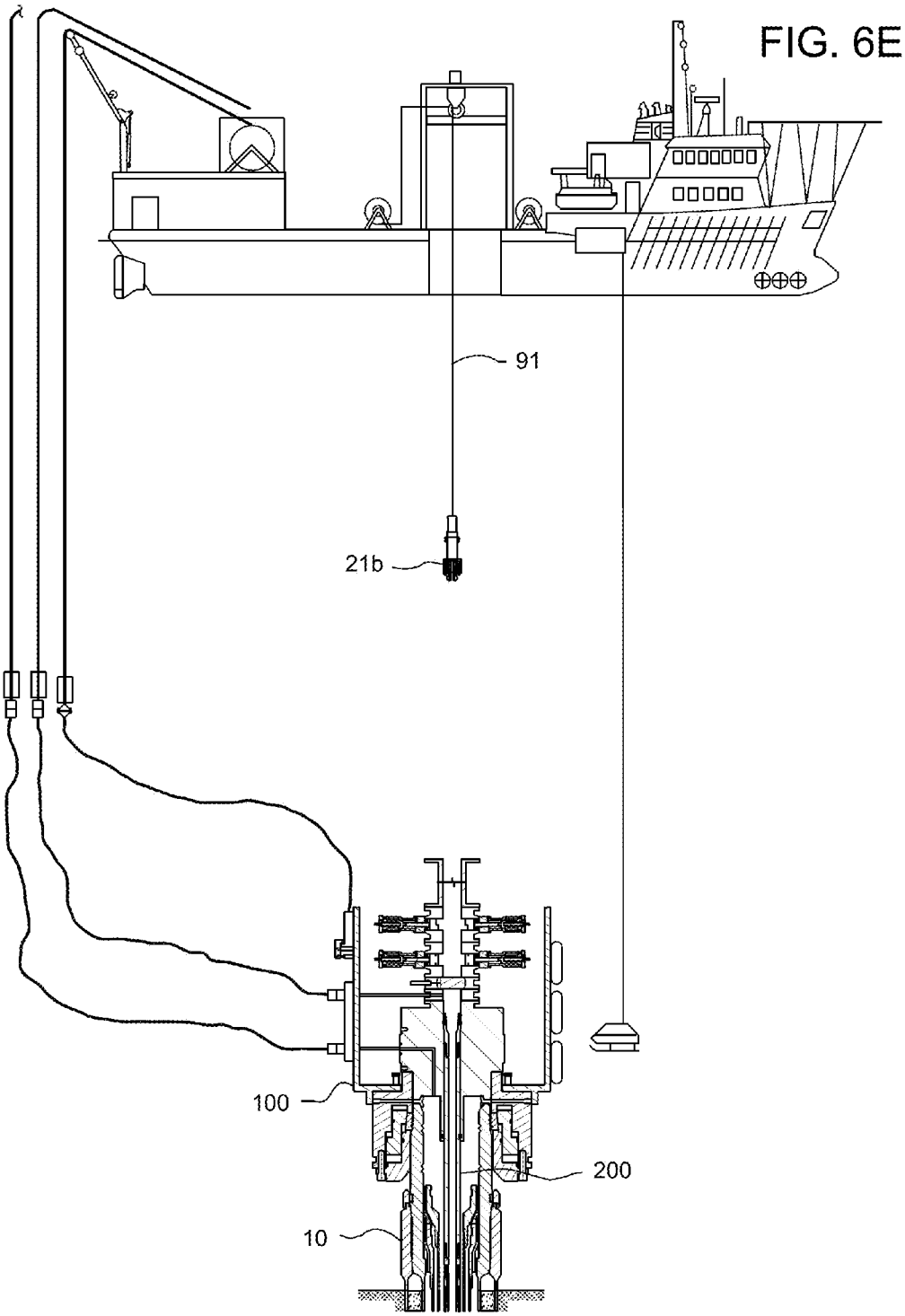
Figure 6F:
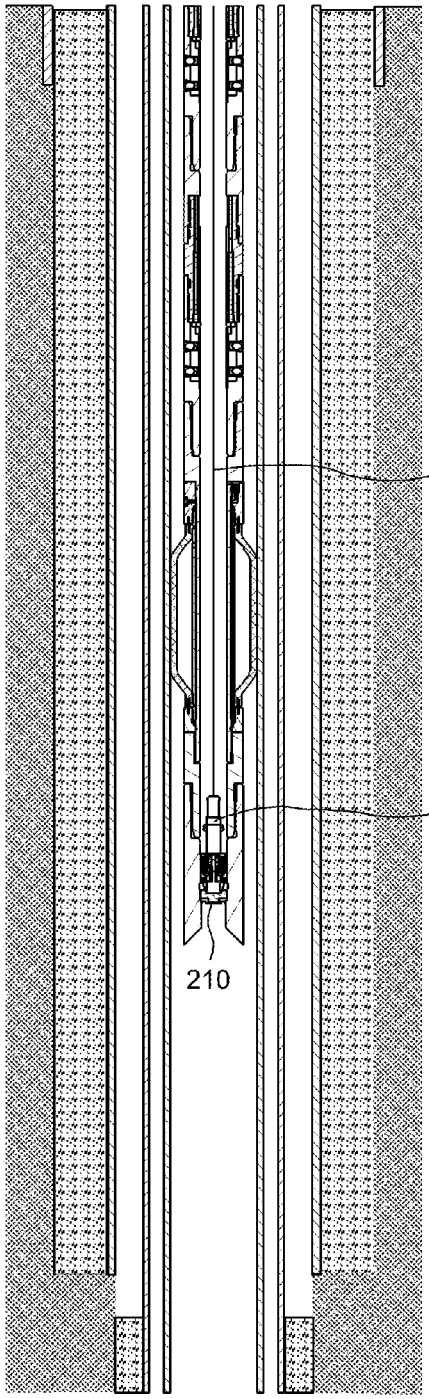

FIG. 6E illustrates deployment of a second PRT 21*b* to the subsea wellhead 10. FIG. 6F illustrates removing the bore plug 210. Once the packer 215 has been inflated, the isolation valve 115 may be opened the wireline 91 may be connected to a second (smaller) PRT 21*b*. The second PRT 21*b* may then be deployed through the moonpool 77 using the wireline winch 76 and lowered through second PCA 100 and into the tool string bore to the bore plug 210. The van operator may then supply electricity to the second PRT 21*b* via the wireline 91 and operate the second PRT to engage and remove the bore plug 210 from the profile 222. The second PRT 21*b* and bore plug 210 may then be retrieved to the vessel 75. The isolation valve 115 may then be closed by the van operator via the umbilical 65 and subsea control system.

Figure 7A:
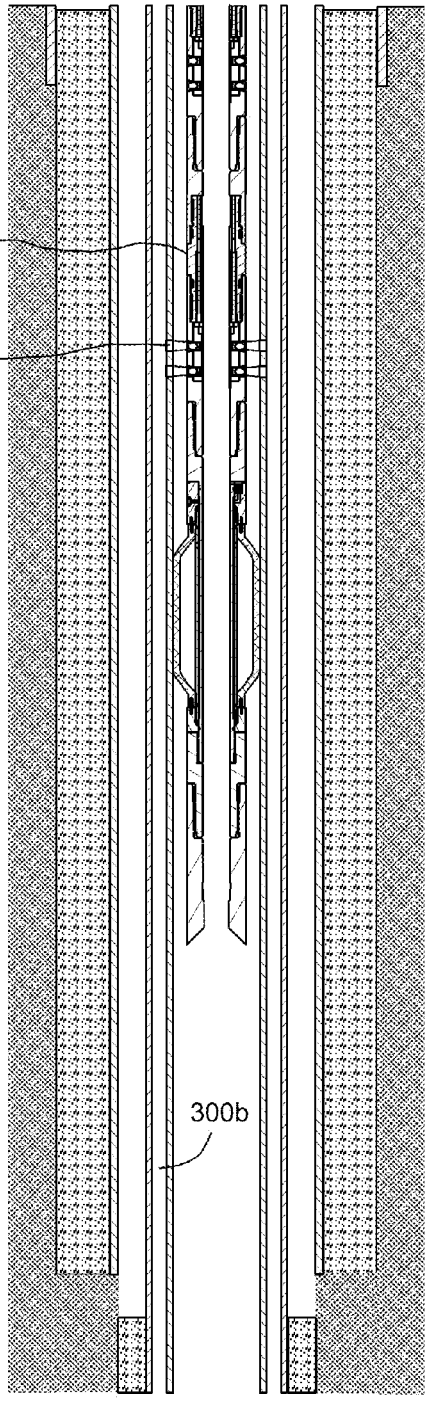
FIGS. 7A-7F illustrate abandonment of an upper portion of the wellbore, according to another embodiment of the present invention.
Figure 7B:
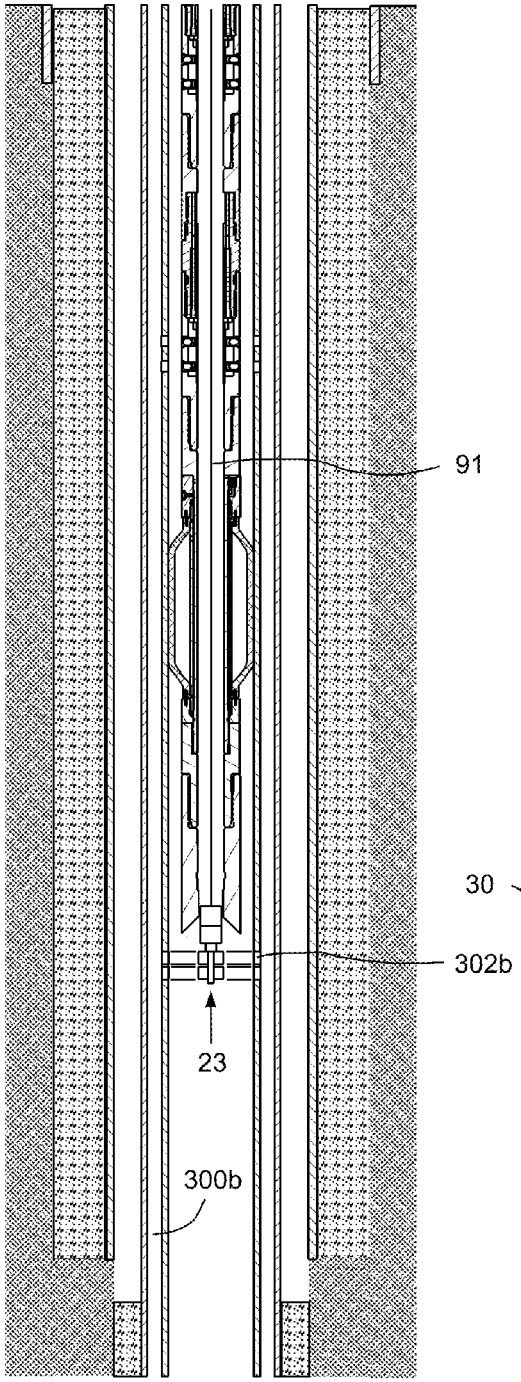
Figure 7C:
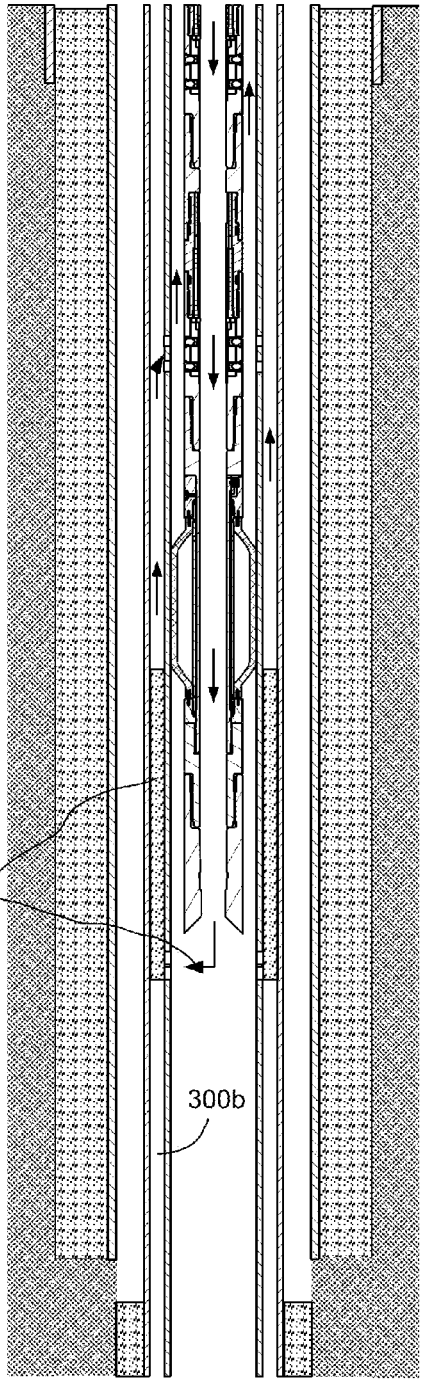

FIGS. 7A-7F illustrate abandonment of an upper portion of the wellbore 2, according to another embodiment of the present invention. FIGS. 7A-7C illustrate cement plugging of an annulus 300*b* (aka the B annulus) formed between the production casing 6*c* and the intermediate casing 5*c*. Once the isolation valve 115 has been closed, the perforating gun 211 may be fired. Fluid pressure in an annulus 300*a* and chamber 150 may be increased by pumping down the return line 170 until the firing differential has been achieved, thereby firing the gun 211 into the production casing 6*c*. The shaped charges 226 of the perforating gun 211 may have a charge strength sufficient to form upper perforations 302*u* through a wall of the production casing 6*c* without damaging a wall of the intermediate casing 5*c*, thereby providing access to the B annulus 300*b*.

The BHA 23 and wireline module 22 may then be redeployed to the PCA 20 and into the wellbore 2 using the wireline 91. The isolation valve 115 may be opened. The BHA 23 may be redeployed to a depth below the shoe 220 and above a top of the intermediate casing cement 8*i*. Once the BHA 23 has been deployed to the setting depth, electricity may then be supplied to the BHA via the wireline 91 to fire the perforating gun into the production casing 6*c*, thereby forming lower perforations 302*b* through a wall thereof. The BHA 23 may be retrieved to the wireline module 22, the isolation valve 115 closed, and the wireline module dispatched from the PCA 20 to the vessel 75.

Cement slurry 30 may then be pumped from the vessel 75, down the supply fluid conduit 70, through the conduit 108*i* and fluid sub port 110*p*, and into a bore of the second PCA 100. The cement slurry 30 may continue into the hanger 205 and down the tool string bore and may exit the tool string 200 at the shoe 220. The cement slurry 30 may continue into the B annulus 300*b* via lower perforations 302*b*. The displaced wellbore fluid may flow from the B annulus 300*b* into the casing/string annulus 300*a* via upper perforations 302*u*. The displaced wellbore fluid may continue up the casing/string annulus 300*a*, through the wellhead 10, and into the return fluid conduit 170 via the fluid passage 107 and conduit 1080. The displaced wellbore fluid may continue up the fluid conduit 170 to the vessel 75. The cement slurry 30 in the B annulus 300*b* may then be allowed to cure, thereby forming B annulus cement plug 303*b*.

Figure 7D:
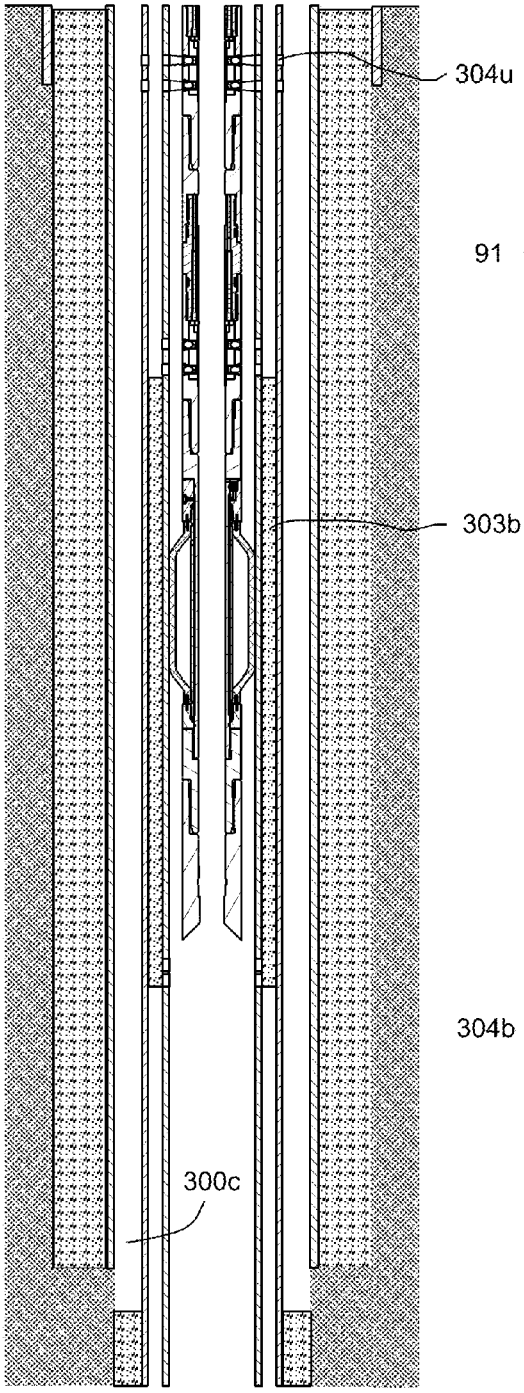
Figure 7E:
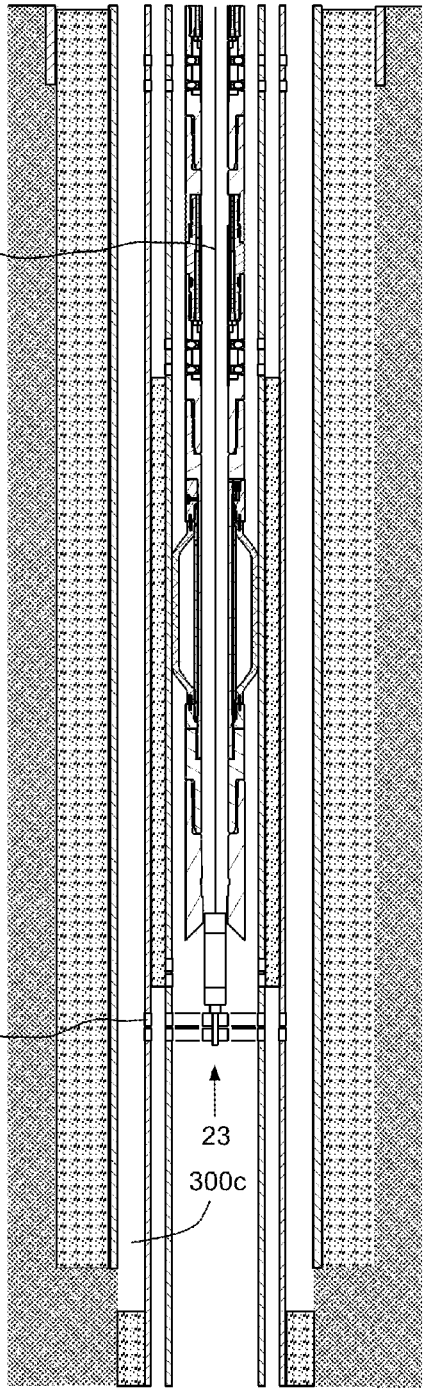
Figure 7F:
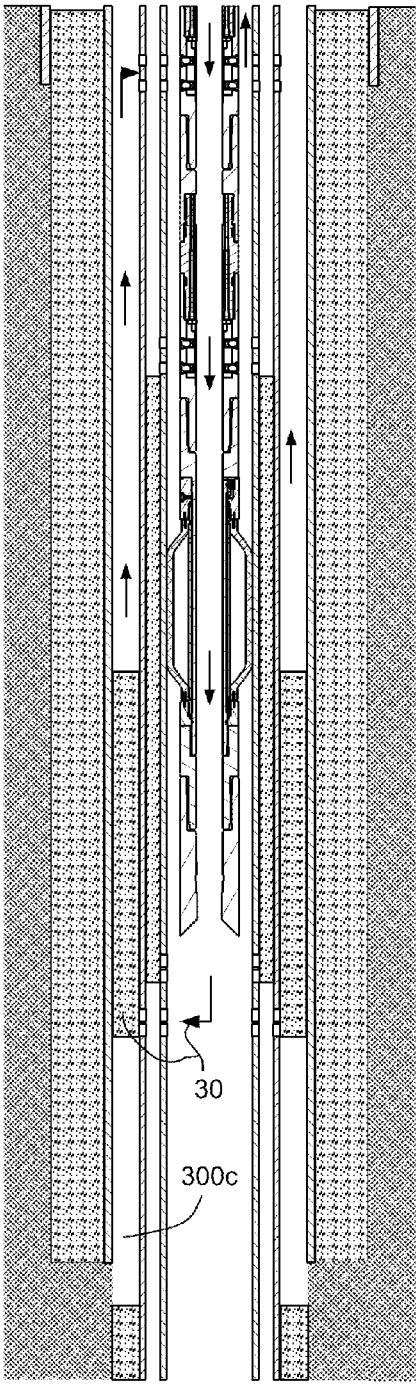

FIGS. 7D-7F illustrate cement plugging of an annulus 300*c* (aka the C annulus) formed between the intermediate casing 5*c* and the surface casing 4*c*. Once the B annulus cement plug 303*b* has formed, the perforating gun 209 may be fired. Fluid pressure in an annulus 300*a* and chamber 150 may be increased by pumping down the return line 170 until the (increased) firing differential has been achieved, thereby firing the gun 209 through the production casing 6*c* and into the intermediate casing 5*c*. The shaped charges of the perforating gun 209 may have a charge strength sufficient to form upper perforations 304*u* through a wall of the production 6*c* and intermediate 5*c* casings without damaging a wall of the surface casing 4*c*, thereby providing access to the C annulus 300*c*.

The BHA 23 and wireline module 22 may then be redeployed to the PCA 20 and into the wellbore 2 using the wireline 91. The isolation valve 115 may be opened. The BHA 23 may be redeployed to a depth below the lower perforations 302*b* and above a top of the intermediate casing cement 8*i*. Once the BHA 23 has been deployed to the setting depth, electricity may then be supplied to the BHA via the wireline 91 to fire the perforating gun through the production casing 6*c* and into the intermediate casing 5*c*, thereby forming lower perforations 304*b* through a wall thereof. The BHA 23 may be retrieved to the wireline module 22, the isolation valve 115 closed, and the wireline module dispatched from the PCA 20 to the vessel 75.

Cement slurry 30 may then be pumped from the vessel 75, down the supply fluid conduit 70, through the conduit 108*i* and fluid sub port 110*p*, and into a bore of the second PCA 100. The cement slurry 30 may continue into the hanger 205 and down the tool string bore and may exit the tool string 200 at the shoe 220. The cement slurry 30 may continue into the C annulus 300*c* via lower perforations 304*b*. The displaced wellbore fluid may flow from the C annulus 300*c* into the casing/string annulus 300*a* via upper perforations 304*u*. The displaced wellbore fluid may continue up the casing/string annulus 300*a*, through the wellhead 10, and into the return fluid conduit 170 via the fluid passage 107 and conduit 1080. The displaced wellbore fluid may continue up the fluid conduit 170 to the vessel 75. The cement slurry 30 in the C annulus 300*c* may then be allowed to cure, thereby forming C annulus cement plug 303*c*.

Figure 7G:
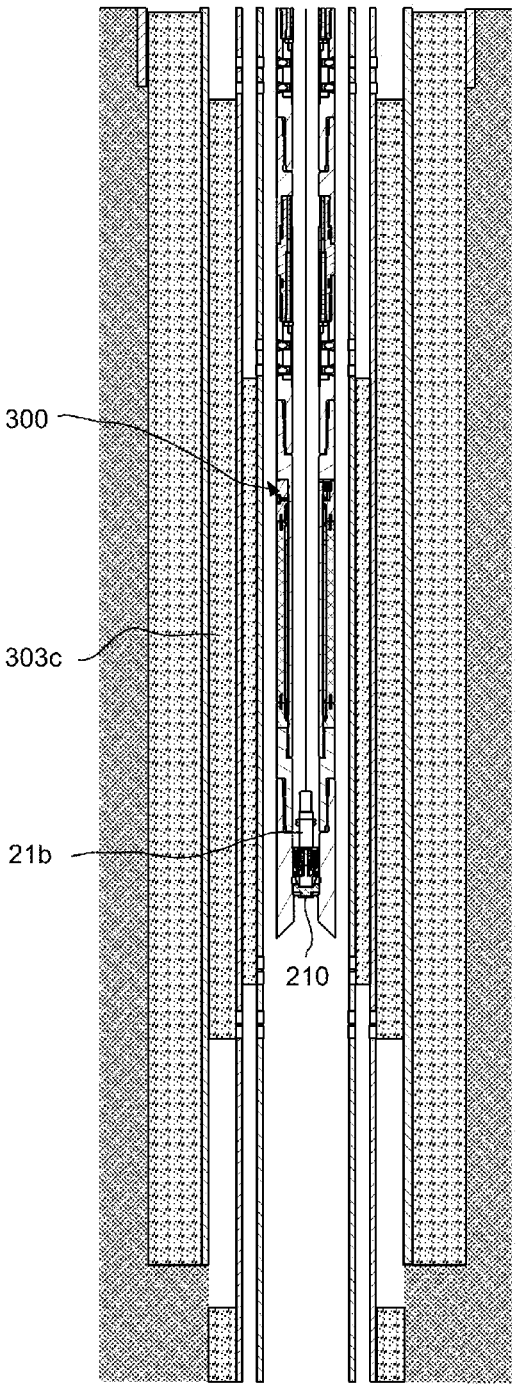
FIG. 7G illustrates deflation of the tool string packer.

FIG. 7G illustrates deflation of the tool string packer. Once the C annulus cement plug 303*c* has formed, the second PRT 21*b* carrying the bore plug 210 and wireline module 22 may then be redeployed to the PCA 20 and into the wellbore 2 using the wireline 91. The isolation valve 115 may be opened. The second PRT 21*b* may be lowered to the shoe profile 222 and operated to reset the bore plug 210. The second PRT 21*b* may be retrieved to the wireline module 22, the isolation valve 115 closed, and the wireline module dispatched from the PCA 20 to the vessel 75. Pumping may continue, thereby increasing pressure in the tool string bore and bladder chamber until the rupture pressure differential is achieved, thereby bursting the rupture disk 277 and allowing deflation of the bladder 260.

The PRT 21 may then be deployed from the vessel 75 using the wireline 91. The isolation valve 115 may be opened. The PRT 21 may then be landed on the hanger 205 and operated to disengage the latch 207. The tool string 200 may then be retrieved to the vessel using the PRT 21 and the wireline 91.

Figure 8A:
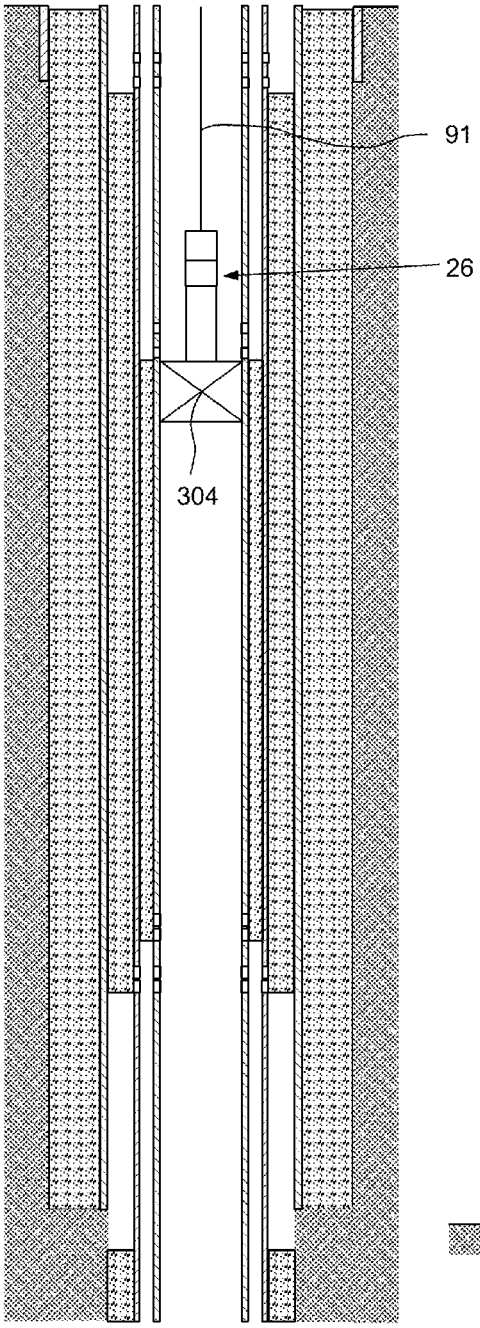
FIGS. 8A and 8B illustrate abandonment of the subsea wellhead.
Figure 8B:
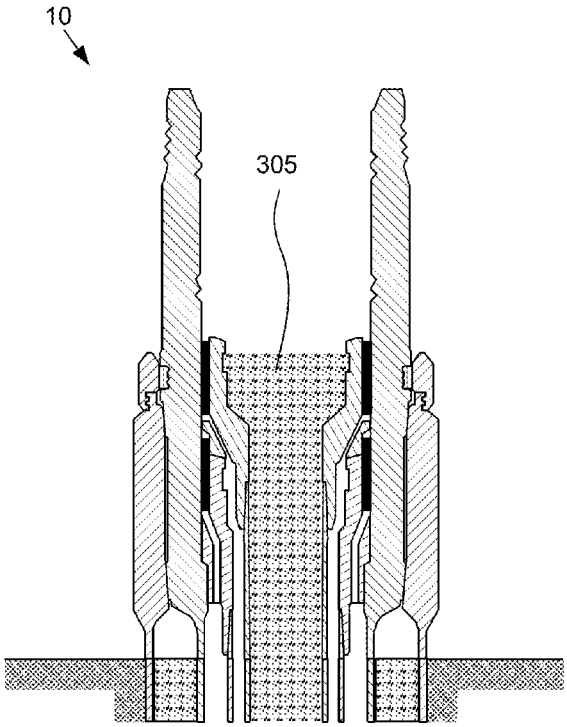

FIGS. 8A and 8B illustrate abandonment of the subsea wellhead 10. FIG. 8A illustrates setting an upper bridge plug 304 in the production casing 6*c*. Once the tool string 200 has been retrieved, the second BHA 26 may be reconnected to the wireline 91 and wireline module 22 and deployed to the second PCA 100. The second BHA 26 may be redeployed to a depth adjacent to and below either of the upper perforations 302*u*, 304*u*. Once the second BHA 26 has been deployed to the setting depth, the upper bridge plug 304 may be set against the inner surface of the production casing 6*c*. Once the upper bridge plug 304 has been set, the plug may be released from the setting tool and the second BHA 26 may then be retrieved to the wireline module 22 and the wireline module dispatched from the PCA 20 to the vessel 75. The second PCA 100 may then be disconnected from the wellhead 10 and retrieved to the vessel 75. Alternatively, the second PCA 100 may be disconnected from the wellhead 10 and retrieved to the vessel 75 before deployment of the second BHA 26 and installation of the upper bridge plug 304.

FIG. 8B illustrates cement plugging of the production casing hanger 6*h*. Once the second PCA 100 has been removed, cement slurry may be pumped into the production casing bore down to the upper bridge plug 304 and allowed to cure, thereby forming a top cement plug 305. The wellhead 10 may then be left utilizing the casing packoffs as additional barriers.

Figure 9A:
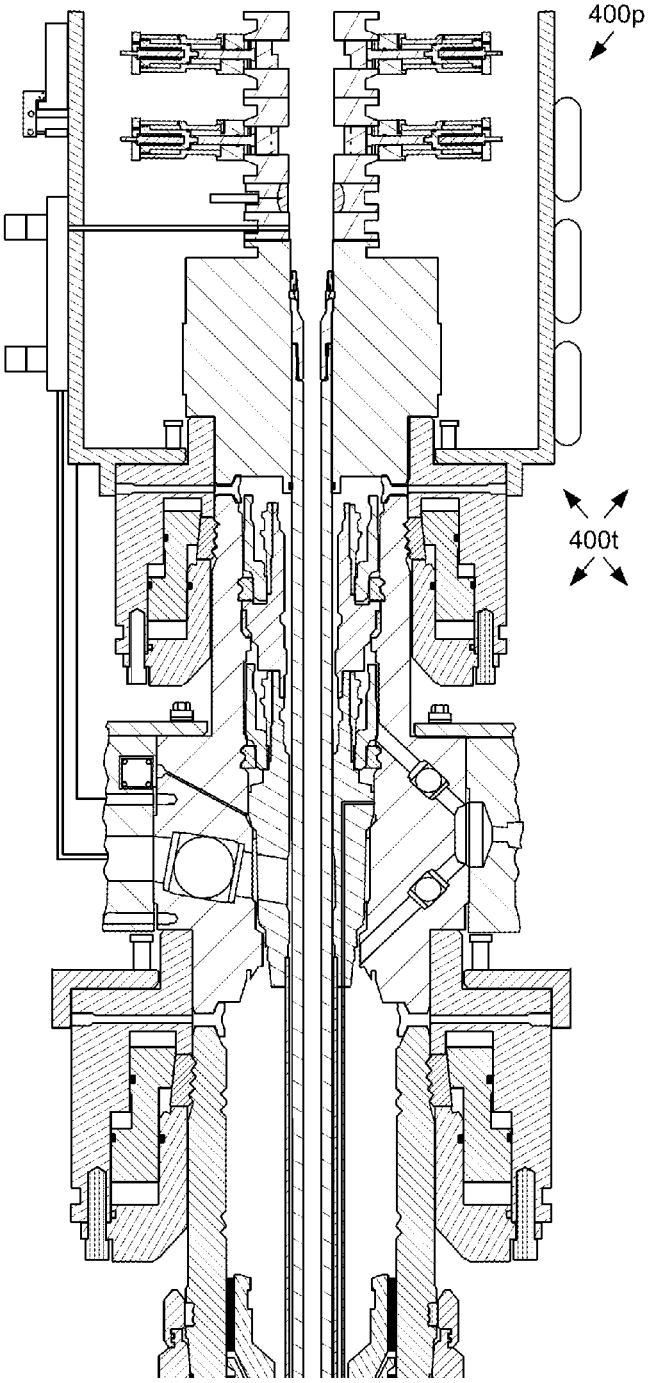
FIGS. 9A and 9B illustrate an alternative second annulus cementing tool string for use with the production tree and a corresponding alternative third PCA, according to another embodiment of the present invention.
Figure 9B:
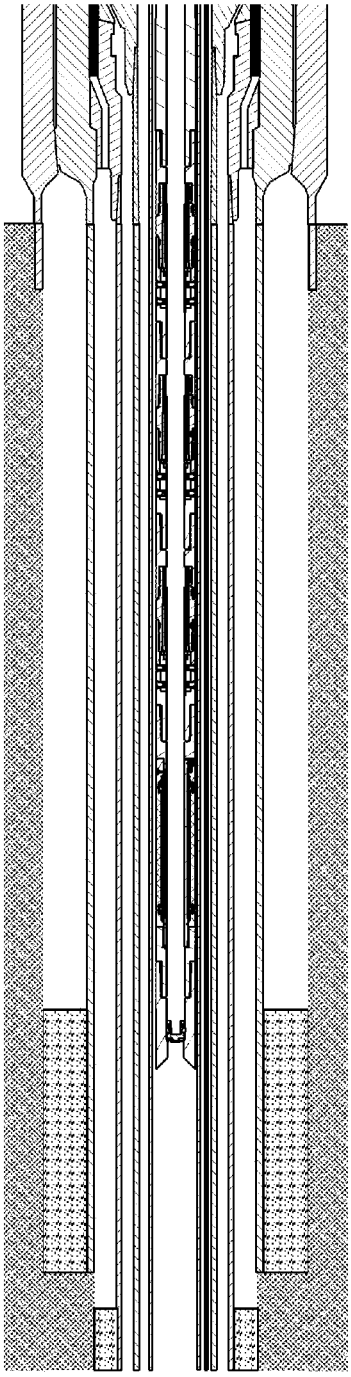

FIGS. 9A and 9B illustrate an alternative second annulus cementing tool string 400*t* for use with the production tree 15 and a corresponding alternative third PCA 400*p*, according to another embodiment of the present invention. The third PCA 400*p* may be similar to the second PCA 100 except for being sized to land on the production tree 15 instead of the wellhead 10 and having a fluid conduit connecting to the production passage of the tree instead of the fluid conduit 108*o* and corresponding passage 107. The second tool string 400*t* may be similar to the tool string 200 except for being sized to land in the production tubing 7 instead of the production casing 6 and having an additional perforating gun capable of perforating through a wall of the production tubing 7 (without damaging the production casing 6). Each of the other perforating guns of the second tool string 400*t* may also be capable of perforation through a wall of the production tubing 7 in addition to their respective casings.

The abandonment operation using the alternative PCA 400*p* and tool string 400*t* may be similar to the abandonment operation discussed above with a few modifications. The third PCA 400*p* may perform functions of both PCAs 20, 100. The second tool string 400*t* may be utilized to form the lower and intermediate A annulus cement plugs 31*b,i* as well as the B and C annuli cement plugs 303*b,c*. The circulation path may utilize the production tubing 7 instead of the surface casing 6 and the production passage of the tree 15 instead of the passage 107. Setting of the tubing bridge plugs 32*b,i*, cutting of the production tubing 7, and removal of the tree 15 may be postponed until after removal of the second tool string 400*t* and before setting of the surface casing bridge plug 304.

Figure 10:
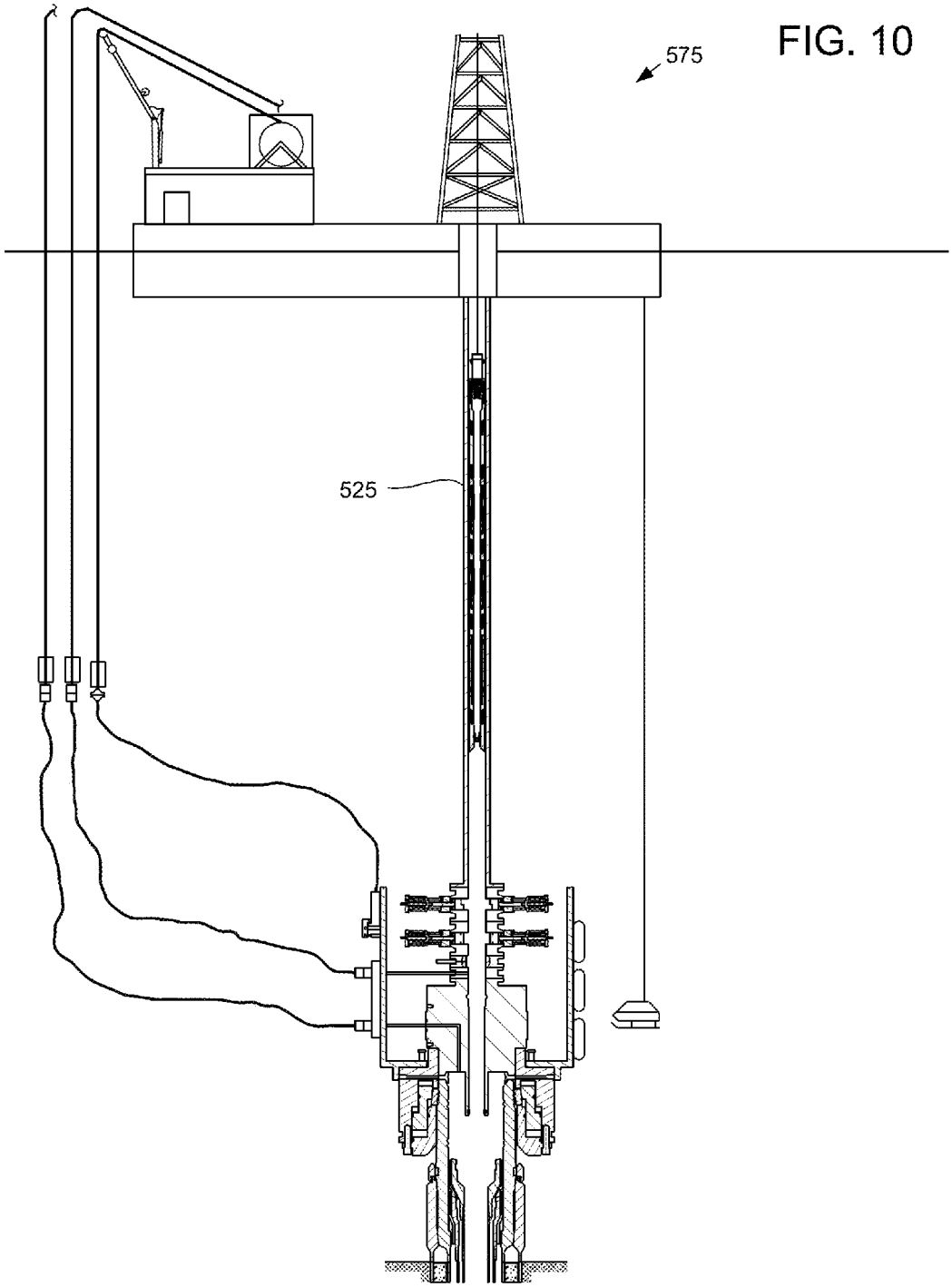
FIG. 10 illustrates alternative deployment of the tool string to the subsea wellhead and the second PCA using a marine riser, according to another embodiment of the present invention.

FIG. 10 illustrates alternative deployment of the tool string 200 to the subsea wellhead 10 and the second PCA 100 using a marine riser 525, according to another embodiment of the present invention. Instead of using the intervention support vessel 75, a offshore drilling unit (ODU) 575 may be used to conduct the abandonment operation. The ODU 575 may connect to the second PCA 100 via the marine riser 525. The ODU 575 may support the marine riser 525 via an upper marine riser package (not shown) and the marine riser may connect to the second PCA 100 via a lower marine riser package (not shown). The marine riser 525 may be used to deploy any of the PCAs 20, 100, 400*p* and/or either of the tool strings 200, 400*t*. Alternatively, a heavy intervention vessel may be used instead of the ODU 575.

Figure 11:
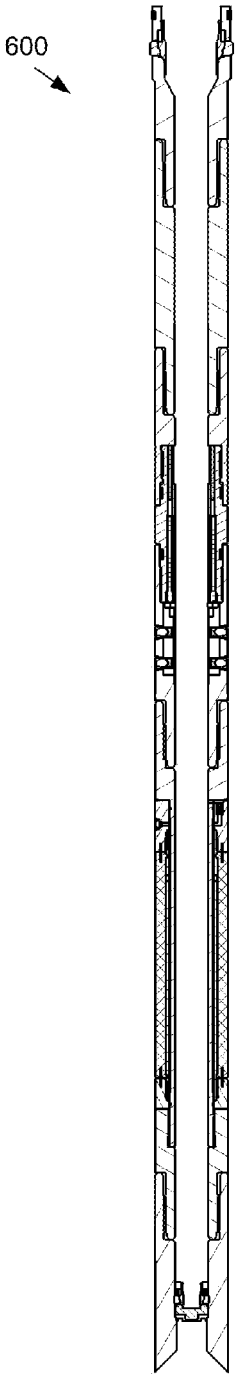
FIG. 11 illustrates an alternative third annulus cementing tool string, according to another embodiment of the present invention.

FIG. 11 illustrates an alternative third annulus cementing tool string 600, according to another embodiment of the present invention. The third tool string 600 may be similar to the tool string 200 except for omission of one of the perforating guns 209, 211. The abandonment operation using the third tool string 600 may be similar to the abandonment operation using the tool string 200 except that the tool string may first be deployed with only the perforating gun 211 and used to perforate and pump the cement slurry for the B annulus cement plug 303*b*. The third tool string 600 may then be retrieved to the vessel 75 before the cement slurry cures. The perforating gun 211 may be replaced with the perforating gun 209 and the third tool string redeployed to the subsea wellhead 10 and reinstalled in the second PCA 100. The third tool string 600 may then be used to perforate and pump the cement slurry for the C annulus cement plug 303*c* and then again be retrieved to the vessel 75 before the cement slurry cures.

Alternatively, the third tool string 600 may be modified for use with the third PCA 400*p*.

Figure 12:
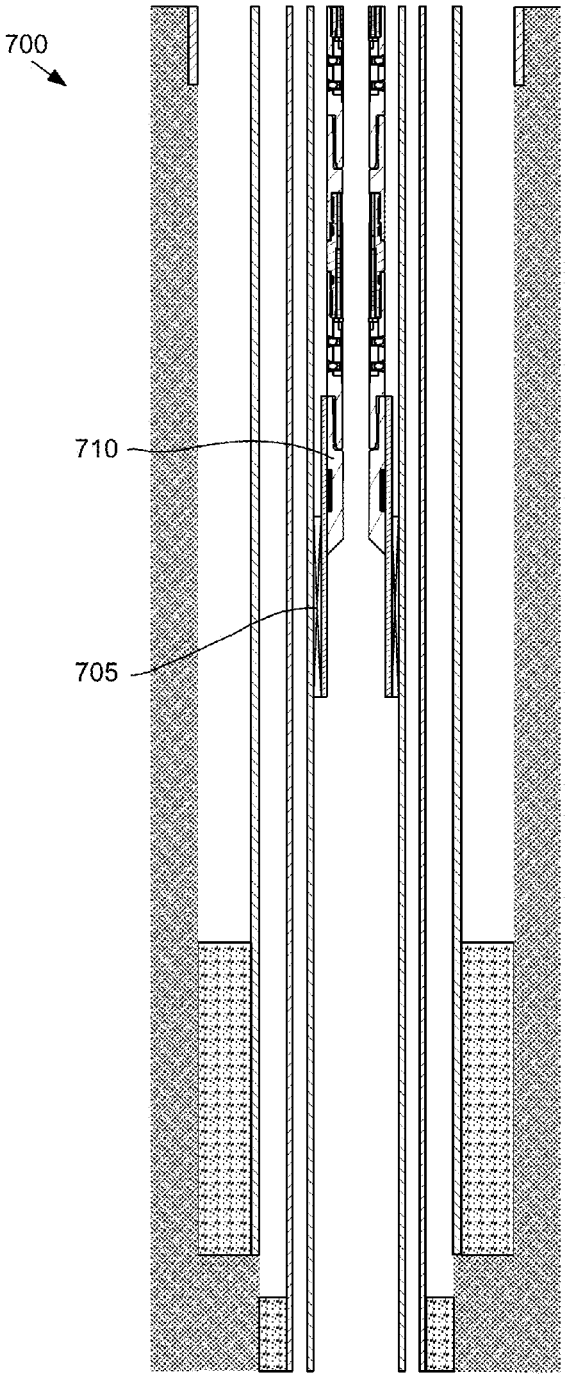
FIG. 12 illustrates an alternative fourth annulus cementing tool string, according to another embodiment of the present invention.

FIG. 12 illustrates an alternative fourth annulus cementing tool string 700, according to another embodiment of the present invention. The fourth tool string 700 may be similar to the tool string 200 except for omission of the packer 215 and replacement of the shoe 220 with a stinger 710. A packer 705 may be set in the production casing bore before deployment of the second PCA 100 and after removal of the production tree 15 from the wellhead 10. The packer 705 may include a mandrel, an anchor, a packing, and a polished bore receptacle. The anchor and packing may be disposed along an outer surface of the packer mandrel between a setting shoulder of the mandrel and a setting ring. The packer 705 may be deployed and set using the second BHA 26. As the fourth tool string 700 is being lowered into the second PCA 100, the stinger 710 may stab into the packer receptacle. The stinger 710 may carry a seal along an outer surface thereof for engaging the packer receptacle. Once the C annulus cement plug 303c has been formed, the fourth tool string 700 may be retrieved and the packer may be left in the production casing.

Alternatively, the third tool string 600 may be modified for use with the packer 705.

Alternatively, the cement slurry may be unbalanced and the packer 705 or any of the other tool strings may include a check valve to prevent U-tubing of the unbalanced cement slurry. The check valve may be locked open to facilitate deployment of the lower perforation guns or be installed in a profile of the packer or the shoe profile after deployment of each lower perforation gun.

Additionally, the well may include a second (or more) intermediate casing string and either tool string may include an additional (or more) pair of perforating guns for forming an additional annulus cement plug.

Additionally, any of the tool strings may further include a disconnect sub (not shown). The disconnect sub may be operable to release a lower portion of the tool string from an upper portion of the tool string should the tool string become stuck in the wellhead and PCA. The disconnect sub may include an upper member connected to the upper portion of the tool string, a lower member connected to the lower portion of the tool string, and a latch fastening the upper and lower members together. The latch may include frangible fasteners set to fail at a tensile force within the capability of the PRT. The disconnect sub may be connected between the hanger and the perforating guns, between the perforating guns and the packer. Additionally, the tool string may include a plurality of disconnects at different locations along the tool string, each disconnect sub set to release at a different tensile force or pressure. Alternatively, if any of the tool strings should become stuck, the third BHA 27 (with tubing cutter or thermite torch) may be deployed and operated to sever a free portion of the string from a stuck portion of the string.

Alternatively, the B and/or C annulus slurry may be bullheaded or squeezed instead of forming the lower perforations. Alternatively, a second (or more) B and/or C annulus plug may be formed along the respective annuli by additional trips with the wireline perforating gun.

Alternatively, the hydraulically operated tool string disclosed in U.S. Prov. Pat. App. No. 61/624,552 , filed Apr. 16, 2012 may be used instead.

While the foregoing is directed to embodiments of the present invention, other and further embodiments of the invention may be devised without departing from the basic scope thereof, and the scope thereof is determined by the claims that follow.

The invention claimed is:

1. A method for abandonment of a subsea well, comprising:

fastening a pressure control assembly (PCA) to a subsea wellhead;

deploying a tool string into the PCA, wherein the tool string comprises a packer and an upper perforator located above the packer;

closing a bore of the PCA above the tool string with a solid barrier, wherein the solid barrier is at least one of: a blowout preventer of the PCA and an isolation valve of the PCA;

setting the packer against an inner casing hung from the subsea wellhead at a location adjacent to an outer casing hung from the subsea wellhead;

while the PCA bore is closed, perforating a wall of the inner casing above the packer by operating the upper perforator;

perforating the inner casing wall below the packer; and injecting cement slurry into an inner annulus formed between the inner casing and the outer casing, wherein:

the cement slurry is injected into the inner annulus by a circulation path including a bore of the tool string, the perforations above and below the packer, and a chamber formed between the subsea wellhead and the tool string, injecting the cement slurry into the circulation path displaces wellbore fluid through the perforations above the packer and into the inner casing, and the method is performed riserlessly.

2. The method of claim 1, wherein:

a bore of the tool string is closed during deployment, and the packer is set by pressurizing the closed tool string bore.

3. The method of claim 2, wherein the packer is set before operation of the upper perforator and while the PCA bore is closed.

4. The method of claim 3, wherein:

the method further comprises opening the tool string bore after setting the packer, the upper perforator is a perforating gun, and the upper perforating gun is fired by pressurizing a chamber formed between the subsea wellhead and the tool string.

5. The method of claim 2, further comprising opening the tool string bore after the packer is set.

6. The method of claim 5, wherein:

the tool string bore is closed by a plug, and tool string bore is opened by retrieving the plug using a workline and workline operated plug running tool.

7. The method of claim 1, wherein the perforations below the packer are formed by deploying a lower perforator through a bore of the tool string.

8. The method of claim 7, wherein the lower perforator is deployed using a workline.

9. The method of claim 1, wherein:

the tool string further comprises a hanger, and the method further comprises landing the hanger in the PCA.

10. The method of claim 1, further comprising perforating a wall of the outer casing above the packer and while the PCA bore is closed.

11. The method of claim 10, further comprising:

perforating the outer casing wall below the packer; and injecting cement slurry into an outer annulus by a circulation path including a bore of the tool string, the outer perforations above and below the packer, and a chamber formed between the subsea wellhead and the tool string.

12. The method of claim 1, further comprising:

lowering the PCA from a vessel to the subsea wellhead; and establishing communication between a control system of the PCA and the vessel, wherein:

the tool string is deployed from the vessel, and the solid barrier is closed using the control system.

13. The method of claim 1, further comprising:

removing the tool string from the PCA after injection of the cement slurry;

removing the PCA from the subsea wellhead;

setting a bridge plug in the inner casing; and forming a cement plug on the set bridge plug and into the subsea wellhead.

14. The method of claim 1, further comprising:

severing an upper portion of production tubing from a lower portion thereof; and retrieving the severed portion from the subsea well, wherein the PCA is fastened, the tool string is deployed, the bore is closed, the packer is set, the inner casing is perforated, and the cement slurry is injected after retrieving the severed portion from the subsea well.

15. The method of claim 14, wherein the severed portion is retrieved by retrieving a production tree from the subsea wellhead.

16. The method of claim 1, wherein the PCA comprises a blowout preventer stack.

17. A method for abandonment of a subsea well, comprising:

setting a packer against a bore of an inner casing hung from a subsea wellhead at a location adjacent to an outer casing hung from the subsea wellhead;

fastening a pressure control assembly (PCA) to the subsea wellhead;

deploying a tool string into the PCA and stabbing the tool string into the packer, wherein the tool string comprises a stinger and an upper perforator located above the stinger;

closing a bore of the PCA above the tool string with a solid barrier, wherein the solid barrier is at least one of: a blowout preventer of the PCA and an isolation valve of the PCA;

while the PCA bore is closed, perforating a wall of the inner casing above the packer by operating the upper perforator;

perforating the inner casing wall below the packer; and injecting cement slurry into an inner annulus formed between the inner casing and the outer casing, wherein:

the cement slurry is injected into the inner annulus by a circulation path including a bore of the tool string, the perforations above and below the packer, and a chamber formed between the subsea wellhead and the tool string, injecting the cement slurry into the circulation path displaces wellbore fluid through the perforations above the packer and into the inner casing, and the method is performed riserlessly.

18. The method of claim 17, further comprising deploying the packer to the subsea wellhead using a workline and workline operated setting tool.

19. The method of claim 18, wherein the packer is deployed and set before fastening the PCA to the subsea wellhead.

20. The method of claim 19, wherein:

the upper perforator is a perforating gun, and the upper perforating gun is fired by pressurizing a chamber formed between the subsea wellhead and the tool string.

21. The method of claim 17, wherein the perforations below the packer are formed by deploying a lower perforator through a bore of the tool string.

22. The method of claim 21, wherein the lower perforator is deployed using a workline.

23. The method of claim 22, wherein:

the cement slurry cures to form a plug, and the method further comprises:

redeploying the lower perforator using the workline;

reperforating the inner casing wall below the packer; and reinjecting cement slurry into the inner annulus to form a second plug.

24. The method of claim 17, wherein:

the tool string further comprises a hanger, and the method further comprises landing the hanger in the PCA.

25. The method of claim 17, further comprising perforating a wall of the outer casing above the packer.

26. The method of claim 25, further comprising:

perforating the outer casing wall below the packer; and injecting cement slurry into an outer annulus by a circulation path including a bore of the tool string, the outer perforations above and below the packer, and a chamber formed between the subsea wellhead and the tool string.

27. The method of claim 17, further comprising:

lowering the PCA from a vessel to the subsea wellhead; and establishing communication between a control system of the PCA and the vessel, wherein:

the tool string is deployed from the vessel, and the solid barrier is closed using the control system.

28. The method of claim 17, further comprising:

removing the tool string from the PCA after injection of the cement slurry;

removing the PCA from the subsea wellhead;

setting a bridge plug in the inner casing; and forming a cement plug on the set bridge plug and into the subsea wellhead.

29. The method of claim 17, wherein:

the PCA is a second PCA, and the method further comprises:

fastening a first PCA to a production tree atop the subsea wellhead;

plugging a lower portion of production tubing hung from the production tree;

severing an upper portion of the production tubing from a lower portion thereof; and removing the production tree from the subsea wellhead.

30. The method of claim 17, further comprising:

severing an upper portion of production tubing from a lower portion thereof; and retrieving the severed portion from the subsea well, wherein the packer is set, the PCA is fastened, the tool string is deployed, the bore is closed, the inner casing is perforated, and the cement slurry is injected after retrieving the severed portion from the subsea well.

31. The method of claim 30, wherein the severed portion is retrieved by retrieving a production tree from the subsea wellhead.

32. The method of claim 17, wherein the PCA comprises a blowout preventer stack.

33. A method of abandoning a subsea well, comprising:

providing a subsea wellhead having an inner and outer concentric strings of tubing below the wellhead, the concentric strings forming an annulus therebetween;

isolating an upper portion of the inner tubing string from a lower portion thereof;

perforating the inner tubing at a location above and below the point of isolation, thereby forming a fluid path in the annulus between the upper and lower perforations; and injecting cement through the lower perforations, thereby at least partially filling the fluid path with cement, wherein injecting the cement into the fluid path displaces wellbore fluid through the upper perforations and into the inner tubing.

34. The method of claim 33, wherein the upper perforations are made with an upper perforating gun and the lower perforations are made with a lower perforating gun.

35. The method of claim 34, wherein the isolating is performed with a packer.

36. The method of claim 35, further comprising deploying a tool string and stabbing the tool string into the packer, wherein the tool string comprises a stinger and an upper perforator located above the stinger.

* * * * *